US008586953B2

(12) United States Patent
Komori et al.

(10) Patent No.: US 8,586,953 B2
(45) **Date of Patent: *Nov. 19, 2013**

(54) EXTREME ULTRA VIOLET LIGHT SOURCE DEVICE

(75) Inventors: Hiroshi Komori, Hiratsuka (JP); Yoshifumi Ueno, Hiratsuka (JP); Georg Soumagne, Kamakura (JP)

(73) Assignee: Gigaphoton Inc., Tochigi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/370,074

(22) Filed: Feb. 9, 2012

(65) Prior Publication Data

US 2012/0261596 A1 Oct. 18, 2012

Related U.S. Application Data

(63) Continuation of application No. 11/730,139, filed on Mar. 29, 2007, now Pat. No. 8,143,606.

(30) Foreign Application Priority Data

Mar. 31, 2006 (JP) ..... 2006-097037

(51) Int. Cl.
*G21G 4/00* (2006.01)

(52) U.S. Cl.
USPC ..... 250/504 R; 250/503.1; 250/505.1; 250/492.1; 250/493.1

(58) Field of Classification Search
USPC ..... 250/504 R, 503.1, 505.1, 492.1, 493.1
See application file for complete search history.

(56) References Cited

U.S. PATENT DOCUMENTS

| | | | | |
|---|---|---|---|---|
| 4,943,747 | A | 7/1990 | Lee | |
| 5,483,129 | A * | 1/1996 | Yamamoto | 315/503 |
| 6,954,129 | B2 | 10/2005 | Buswell | |
| 6,987,279 | B2 * | 1/2006 | Hoshino et al. | 250/504 R |
| 7,033,462 | B2 | 4/2006 | Murakami et al. | |
| 7,087,914 | B2 * | 8/2006 | Akins et al. | 250/504 R |
| 2004/0108473 | A1 * | 6/2004 | Melnychuk et al. | 250/504 R |
| 2004/0238762 | A1 * | 12/2004 | Mizoguchi et al. | 250/504 R |
| 2005/0167618 | A1 * | 8/2005 | Hoshino et al. | 250/504 R |
| 2005/0205810 | A1 * | 9/2005 | Akins et al. | 250/504 R |
| 2006/0132046 | A1 * | 6/2006 | Schwarzl et al. | 315/111.41 |
| 2006/0186356 | A1 * | 8/2006 | Imai et al. | 250/504 R |
| 2006/0249698 | A1 * | 11/2006 | Endo et al. | 250/504 R |
| 2008/0258085 | A1 * | 10/2008 | Bauer | 250/504 R |

FOREIGN PATENT DOCUMENTS

| | | | |
|---|---|---|---|
| JP | 2005-197456 | 7/2005 | |
| JP | 2006-080255 A | 3/2006 | |
| JP | 2006080255 A * | 3/2006 | H01L 21/027 |

OTHER PUBLICATIONS

Japanese Notification of Reason(s) for Rejection, w/ partial English translation thereof, issued in Japanese Patent Application No. JP 2006-097307 dated Jul. 5, 2011.

* cited by examiner

*Primary Examiner* — Michael Logie
(74) *Attorney, Agent, or Firm* — McDermott Will & Emery LLP

(57) ABSTRACT

An extreme ultra violet light source device of a laser produced plasma type, in which charged particles such as ions emitted from plasma can be efficiently ejected. The extreme ultra violet light source device includes: a target nozzle that supplies a target material; a laser oscillator that applies a laser beam to the target material supplied from the target nozzle to generate plasma; collector optics that collects extreme ultra violet light radiated from the plasma; and a magnetic field forming unit that forms an asymmetric magnetic field in a position where the laser beam is applied to the target material.

18 Claims, 22 Drawing Sheets

EXTREME ULTRA VIOLET LIGHT SOURCE DEVICE

RELATED APPLICATIONS

This application is a Continuation of U.S. application Ser. No. 11/730,139, filed on Mar. 29, 2007, now U.S. Pat. No. 8,143,606 claiming priority of Japanese Patent Application No. 2006-097037, filed on Mar. 31, 2006, the disclosures of which Applications are incorporated by reference herein.

BACKGROUND OF THE INVENTION

1. Field of the Invention

The present invention relates to an extreme ultra violet light source device, which is used as alight source of exposure equipment, for generating extreme ultra violet (EUV) light by applying a laser beam to a target.

2. Description of Related Art

In recent years, photolithography has made rapid progress toward finer fabrication with finer semiconductor processes. In the next generation, microfabrication of 100 nm to 70 nm, and even microfabrication of 50 nm or less, will be required. For example, in order to fulfill the requirement for microfabrication of 50 nm or less, the development of exposure equipment with a combination of an EUV light source of about 13 nm in wavelength and a reduced projection reflective optics is expected.

There are three kinds of light sources which are used as an EUV light source: an LPP (laser produced plasma) light source using plasma generated by applying a laser beam to a target (hereinafter, also referred to as "LPP type EUV light source device", a DPP (discharge produced plasma) light source using plasma generated by discharge, and an SR (synchrotron radiation) light source using orbital radiation. Among them, the LPP light source has the advantages that extremely high intensity near black body radiation can be obtained because plasma density can be considerably made larger, light emission of only the necessary waveband can be performed by selecting the target material, and an extremely large collection solid angle of $27\pi$ steradian can be ensured because it is a point source having substantially isotropic angle distribution and there is no structure such as electrodes surrounding the light source. Therefore, the LPP light source is thought to be predominant as a light source for EUV lithography requiring power of several tens of watts.

FIG. 22 is a diagram for explanation of a principle of generating EUV light in the LPP system. An EUV light source device shown in FIG. 22 includes a laser oscillator 901, collector optics 902 such as a condenser lens and so on, a target supply unit 903, a target nozzle 904, and an EUV collector mirror 905. The laser oscillator 901 is a laser light source that pulse-oscillates to generate a laser beam for exciting a target material. The condenser lens 902 condenses the laser beam outputted from the laser oscillator 901 to a predetermined position. Further, the target supply unit 903 supplies the target material to the target nozzle 904 and injects the supplied target material to the predetermined position.

When the laser beam is applied to the target material injected from the target nozzle 904, the target material is excited and plasma is generated, and various wavelength components are radiated from the plasma.

The EUV collector mirror 905 has a concave reflection surface that reflects and collects the light radiated from the plasma. A film in which molybdenum and silicon are alternately stacked (Mo/Si multilayered film), for example, is formed on the reflection surface for selective reflection of a predetermined wavelength component (e.g., near 13.5 nm). Thereby, the predetermined wavelength component radiated from the plasma is outputted to an exposure tool or the like as output EUV light.

In the LPP type EUV light source device, there is a problem of the influence by charged particles such as fast ions emitted from plasma. This is because the EUV collector mirror 905 is located relatively near the plasma emission point (the position where the laser beam is applied to the target material), and thus, the fast ions and so on collide with the EUV collector mirror 905 and the reflection surface of the mirror (Mo/Si multilayered film) is sputtered and damaged. Here, in order to improve the EUV light generation efficiency, it is necessary to keep the reflectance of the EUV collector mirror 905 high. For this purpose, high flatness is required for the reflection surface of the EUV collector mirror 905, and the mirror becomes very expensive. Accordingly, longer life of the EUV collector mirror 905 is also desired so as to reduce operation costs of the exposure system including the EUV light source device, to reduce maintenance time, and so on.

As a related technology, U.S. Pat. No. 6,987,279 B2 discloses a light source device including a target supply unit that supplies a material as a target, a laser unit that generates plasma by applying a laser beam to the target, collector optics that collect and output extreme ultra violet light emitted from the plasma, and magnetic field generating means that generates a magnetic field within the collector optics for trapping charged particles emitted from the plasma when electric current is supplied (page 1, FIG. 1). In the light source device, ions generated from the plasma are trapped near the plasma by forming a mirror magnetic field by using electromagnets of Helmholtz type (column 6, FIG. 4). Thereby, the damage on the EUV collector mirror due to so-called debris such as ions is prevented.

Further, according to U.S. Pat. No. 6,987,279 B2, in order to efficiently eject ions and so on from the vicinity of the plasma and the collector mirror to reduce the concentration of the residual target gas (ions and neutralized atoms of the target material) near the plasma, the magnetic field is formed such that the magnetic flux density on the opposite side of the collector mirror becomes lower (columns 7-8, FIGS. 6A-7). Because of the action of the magnetic field, the ions and so on are guided in the direction of the lower magnetic flux density, that is, in the direction opposite to the collector mirror.

However, even when the ions, etc. are led out of the magnetic field in such a manner, the ions, etc. still need to be efficiently ejected out of the chamber. Otherwise, the concentration of the residual target gas (ions and neutralized atoms of the target material) within the chamber will rise. Since the target gas absorbs the EUV light radiated from the plasma, a problem is caused that the available EUV light decreases as the concentration rises. Therefore, it is necessary to locate a mechanism for efficiently ejecting the target gas out of the chamber (e.g., an ejection opening having a large diameter) in an appropriate position in addition to the configuration shown in FIGS. 6A and 7 of U.S. Pat. No. 6,987,279 B2.

In the case of providing a mechanism for ejecting ions, etc. in the device shown in FIGS. 6A and 7 of U.S. Pat. No. 6,987,279 B2, the following problem arises. In a general EUV light source, a filter for purifying the spectrum of EUV light, a coupling mechanism to an exposure tool, and so on are provided at the side opposite to the EUV collector mirror (in the traveling direction of the reflected EUV light). Therefore, in consideration of the interference with the filter, the coupling mechanism and so on, it is difficult to provide the mechanism for ejecting ions, etc. at the side opposite to the collector mirror. On the other hand, in the case where the position of the ejection mechanism, especially the ejection opening to be formed in the chamber, is inappropriate, the ejection speed of ions, etc. becomes lower and the concentration of ions, etc. rises within the chamber. Specifically, it is considered that such a tendency becomes stronger in the case where EUV light is generated by highly repeated operation.

SUMMARY OF THE INVENTION

The present invention has been achieved in view of the above-mentioned problems. A purpose of the present invention is to efficiently eject charged particles such as ions emitted from plasma in an extreme ultra violet light source device of a laser produced plasma type.

In order to accomplish the above purpose, an extreme ultra violet light source device according to one aspect of the present invention is an extreme ultra violet light source device of a laser produced plasma type including: a target nozzle that supplies a target material; a laser oscillator that applies a laser beam to the target material supplied from the target nozzle to generate plasma; collector optics that collects extreme ultra violet light radiated from the plasma; and magnetic field forming means that forms an asymmetric magnetic field in a position where the laser beam is applied to the target material.

According to the present invention, the charged particles such as ions emitted from plasma can be led out in a desired direction by the action of the asymmetric magnetic field formed by the magnetic field forming means. Accordingly, the charged particles such as ions can be promptly eliminated from the vicinity of the EUV collector mirror or the plasma emission point, and therefore, the contamination and damage on the EUV collector mirror and the rise in concentration of ions, etc. can be suppressed.

DESCRIPTION OF THE PREFERRED EMBODIMENTS

Figure 1:
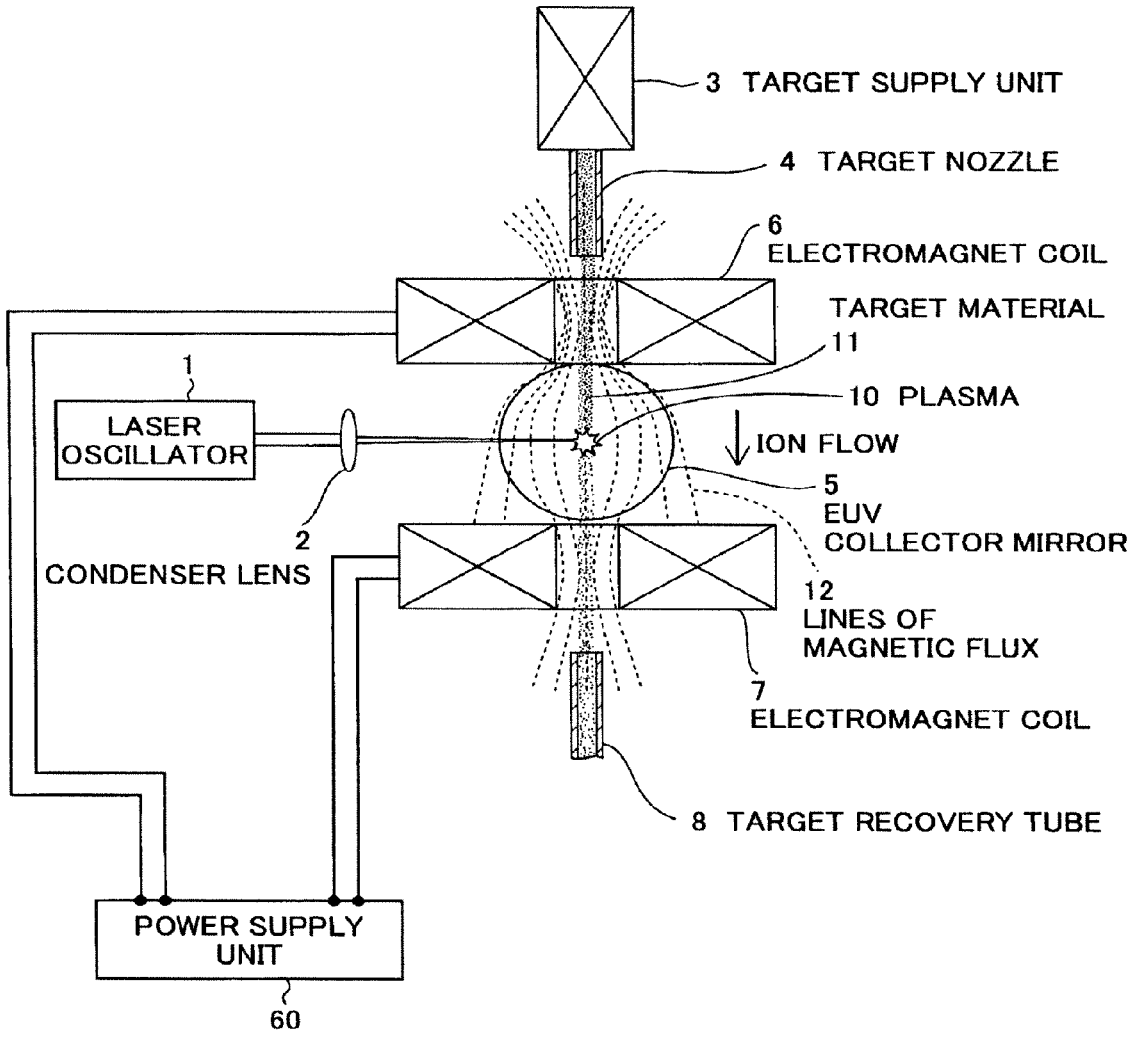
FIG. 1 is a sectional view showing a configuration of an extreme ultra violet light source device according to the first embodiment of the present invention.

Hereinafter, preferred embodiments of the present invention will be explained in detail by referring to the drawings. The same reference numerals are assigned to the same component elements and duplicative description thereof will be omitted.

FIG. 1 is a sectional view showing a configuration of an extreme ultra violet (EUV) light source device according to the first embodiment of the present invention. The EUV light source device according to the embodiment employs a laser produced plasma (LPP) type that generates EUV light by applying a laser beam to a target material for excitation. As shown in FIG. 1, the EUV light source device includes a laser oscillator 1, a condenser lens 2, a target supply unit 3, a target nozzle 4, an EUV collector mirror 5, electromagnets 6 and 7, and a target recovery tube 8. The electromagnets 6 and 7 are connected via wiring to a power supply unit 60 for supplying electric currents to the electromagnets 6 and 7.

The laser oscillator 1 is a laser light source capable of pulse oscillation at a high repetition frequency, and generates a laser beam to be applied to a target material for excitation. Further, the condenser lens 2 constitutes collector optics that collects the laser beam emitted from the laser oscillator 1 to a predetermined position. Although one condenser lens 2 is used as collector optics in the embodiment, the collector optics may be configured by a combination of other collection optical components or plural optical components.

The target supply unit 3 supplies the target material that is excited when applied with the laser beam and turns into a plasma state. As the target material, xenon (Xe), mixture of xenon as the main component, argon (Ar), krypton (Kr), water ($H_2O$) or alcohol, which are in a gas state in a low-pressure condition, molten metal such as tin (Sn) or lithium (Li), water or alcohol in which fine metal particles of tin, tin oxide, cupper or the like are dispersed, an ionic solution of lithium fluoride (LiF) or lithium chloride (LiCl) solved in water, or the like is used.

The state of the target material may be gas, liquid, or solid. In the case where a target material in a gas state at the normal temperature, for example, xenon is used as a liquid target, the target supply unit 3 pressurizes or cools the xenon gas for liquefaction and supplies it to the target nozzle 4. On the other hand, in the case where a material in a solid state at the normal temperature, for example, tin is used as a liquid target, the target supply unit 3 heats tin for liquefaction and supplies it to the target nozzle 4.

The target nozzle 4 injects the target material 11 supplied from the target supply unit 3 to form a target jet or droplet target. In the case where the droplet target is formed, a mechanism (e.g., piezoelectric element) for vibrating the target nozzle 4 at a predetermined frequency is further provided. In this case, the pulse oscillation interval in the laser oscillator 1 is adjusted to a position interval of the droplet target or a time interval of forming the droplet target.

The plasma 10 is generated by applying the laser beam to the target material 11 injected from the target nozzle 4, and light having various wavelength components is emitted therefrom.

The EUV collector mirror 5 is collector optics that collects a predetermined wavelength (e.g., EUV light near 13.5 nm) of the various wavelength components radiated from the plasma 10. The EUV collector mirror 5 has a concave reflection surface, and, for example, a molybdenum (Mo)/silicon (Si) multilayered film, that selectively reflects the EUV light near 13.5 nm, is formed on the reflection surface. Due to the EUV collector mirror 5, the EUV light is reflected and collected in a predetermined direction (the front direction in FIG. 1), and outputted to the exposure tool, for example. The collector optics of EUV light is not limited to the collector mirror as shown in FIG. 1. The collector optics may be configured by employing plural optical components, but it is required to be a reflection optics for suppressing absorption of EUV light.

The electromagnets 6 and 7 are oppositely provided in parallel with each other or in parallel such that the centers of the coils are aligned. Since the electromagnets 6 and 7 are used within the vacuum chamber, the winding wire of the coil and the cooling mechanism of the winding wire are separated from the vacuum space within the chamber by an airtight container covered by a non-magnetic metal such as stainless or ceramic for keeping the degree of vacuum within the chamber and preventing emission of contamination. These electromagnets 6 and 7 generate magnetic fields different in intensity from each other. In the present embodiment, the magnetic field of the electromagnet 6 is stronger than the magnetic field of the electromagnet 7. Thereby, an asymmetric magnetic field with the central openings of the electromagnets 6 and 7 as a central axis of lines of magnetic flux is formed, wherein the magnetic flux density is higher at the electromagnet 6 side and the magnetic flux density is lower at the electromagnet 7 side. FIG. 1 shows lines of magnetic flux 12 of the asymmetric magnetic field.

The target recovery tube 8 is located at a position facing the target nozzle 4 with a plasma emission point in between, in which the plasma emission point corresponds to a position where the laser beam is applied to the target material. The target recovery tube 8 recovers the target material that has not turned into the plasma state though injected from the target nozzle 4. Thereby, contamination of the EUV collector mirror 5 and so on due to flying of the unwanted target material is prevented and the reduction in the degree of vacuum within the chamber is prevented.

Here, referring to FIGS. 2A and 2B, the action of the asymmetric magnetic field formed by the electromagnets 6 and 7 will be explained in detail.

The magnetic field formed by oppositely located two coils is generally called a mirror magnetic field. For example, intensity and orientation of magnetic fields generated by those two coils are made equal, and thereby, a mirror magnetic field is formed in which the magnetic flux density is high near the coils and the magnetic flux density is low at the midpoint between the coils. Further, the intensity of the magnetic fields generated by the two coils is varied from each other, and thereby, an asymmetric magnetic field with respect to a surface perpendicular to the central axis of lines of magnetic flux as shown in FIG. 2A is formed.

Figure 2A:
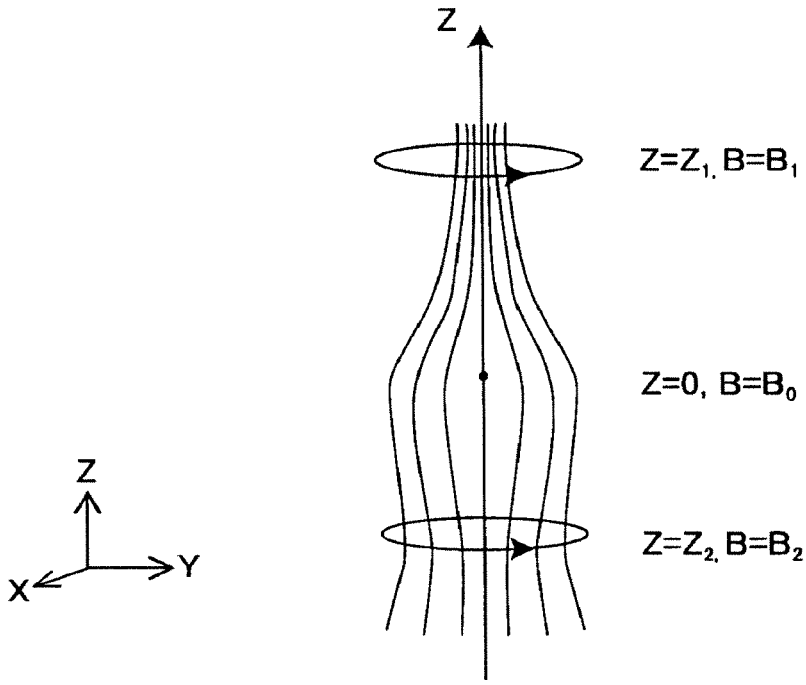
FIGS. 2A and 2B are diagrams for explaining the action of an asymmetric magnetic field shown in FIG. 1.

As shown in FIG. 2A, movement of charged particles in an asymmetric magnetic field where the magnetic flux density is higher toward the positive direction of the Z-axis and the magnetic flux density is lower toward the negative direction of the Z-axis will be considered. Here, the central axis of lines of magnetic flux is the Z-axis, and the upward direction in FIG. 2A is the positive direction. Further, the magnetic flux density $B=B_1$ at the position where $Z=Z_1$, the magnetic flux density $B=B_2$ ($B_1>B_2$) at the position where $Z=Z_2$, the central position between the position $Z_1$ and the position $Z_2$ is the origin ($Z=0$), and the magnetic flux density $B=B_0$ at the origin.

In the case where a charged particle present at the origin has a speed component in the positive Z direction, the charged particle makes drift motion in the positive Z direction while turning by receiving Lorentz force within the XY plane from the magnetic field. At that time, a charged particle that satisfies the following expression (1) passes through the position where $Z=Z_1$ and is ejected to the outside of the magnetic field, and a charged particle that does not satisfy the expression (1) does not reach the position where $Z=Z_1$ and is drawn back in the negative Z direction.

$$\theta_1<\sin^{-1}(B_0/B_1)^{1/2} \tag{1}$$

In the expression (1), the angle $\theta_1$ is a pitch angle of the drift motion of the charged particle (see FIG. 2B) and expressed by the following expression (2).

$$\theta_1=\tan^{-1}(v_{0Z}/v_{0XY}) \tag{2}$$

In the expression (2), the velocity $v_{0Z}$ is a velocity component in the Z direction of the charged particle at the origin, and the velocity $v_{0XY}$ is a velocity component in the XY plane of the charged particle at the origin.

Similarly, in the case where a charged particle present at the origin has a speed component in the negative Z direction, a charged particle that satisfies the following expression (3) passes through the position where $Z=Z_2$ and is ejected to the outside of the magnetic field, and a charged particle that does not satisfy the expression (3) does not reach the position where $Z=Z_2$ and is drawn back in the positive Z direction.

$$\theta_2<\sin^{-1}(B_0/B_2)^{1/2} \tag{3}$$

In the expression (3), the angle $\theta_2$ is a pitch angle of the drift motion of the charged particle (see FIG. 2B) and expressed by the following expression (4).

$$\theta_2=\tan^{-1}(v_{0Z}/v_{0XY}) \tag{4}$$

Figure 2B:
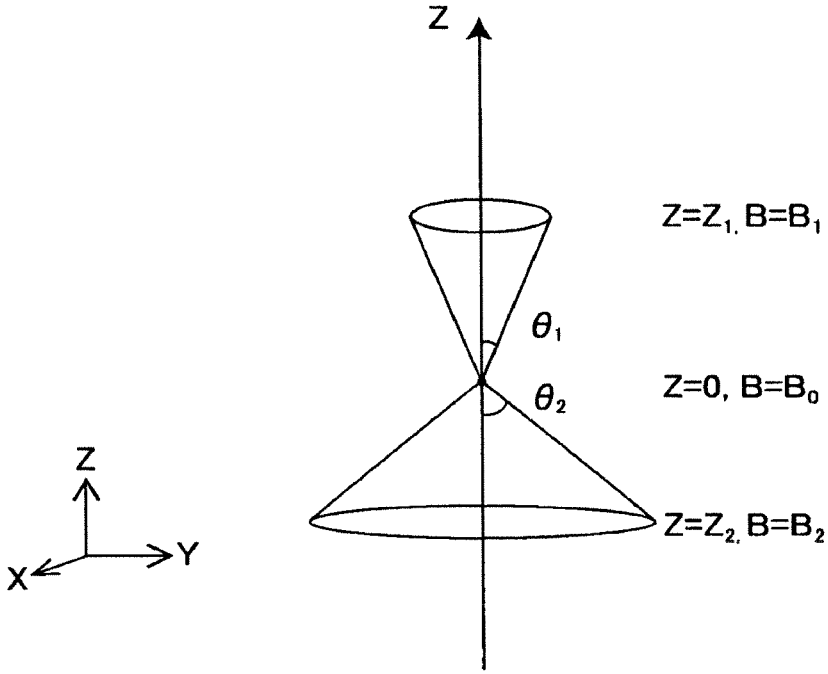

As shown in FIG. 2B, the speed components of the charged particle that satisfies the expression (1) and (3) are expressed by circular cones with the pitch angles $\theta_1$ and $\theta_2$ as apex angles. Such speed components are called loss cones. The smaller the ratio of magnetic flux density (mirror ratio) $B_1/B_0$ or $B_2/B_0$ shown in the expressions (1) and (3), the larger the apex angles of the loss cones become.

Further, as shown in FIG. 2A, the mirror magnetic field that is asymmetric with respect to the XY plane where Z=0 has the following tendency in comparison to a mirror magnetic field that is symmetric with respect to the XY plane where Z=0. That is, the rate, at which the charged particle is drawn back, is higher at the side with higher magnetic flux density ($Z_1$ side), and the rate, at which the charged particle is drawn back, is lower at the side with lower magnetic flux density ($Z_2$ side). Therefore, the charged particle can be guided in a desired direction by changing the mirror ratio.

In the actual LPP type EUV light source, movements of the respective ions are more complex due to collective motion of plasma, however, the outline is the same as that explained by referring to FIGS. 2A and 2B. For more details on mirror magnetic fields, please see Dwight R. Nicholson, "Introduction to Plasma Theory", John Wiley & Sons, Inc., Chapter 2, Section 6, which is incorporated herein by reference.

Referring to FIG. 1 again, when the laser beam is applied to the target material 11, the plasma 10 is generated and EUV light is radiated from the plasma. Similarly, the charged particles such as ions of the target material are also emitted from the plasma 10. The ions are forced by the asymmetric magnetic field formed in the region containing the plasma emission point along the line of magnetic flux mainly toward the direction of the lower magnetic flux density. Thereby, the ions do not stay around the plasma emission point, but pass through the central opening of the electromagnetic mirror and are promptly led out to the outside thereof, i.e., to the outside of the EUV collector mirror 5.

As explained above, according to the embodiment, the charged particles such as ions emitted from the plasma can be efficiently ejected by the action of the asymmetric magnetic field. Thereby, the contamination and damage on the EUV collector mirror can be suppressed, and thus, the reduction in use efficiency of the EUV light due to reflectance reduction of the mirror can be prevented and the life of the EUV collector mirror can be made longer. Further, the absorption of EUV light by the ions, etc. is suppressed by suppressing the concentration rise of ions, etc., and thereby, the use efficiency of the EUV light can be improved.

Figure 3A:
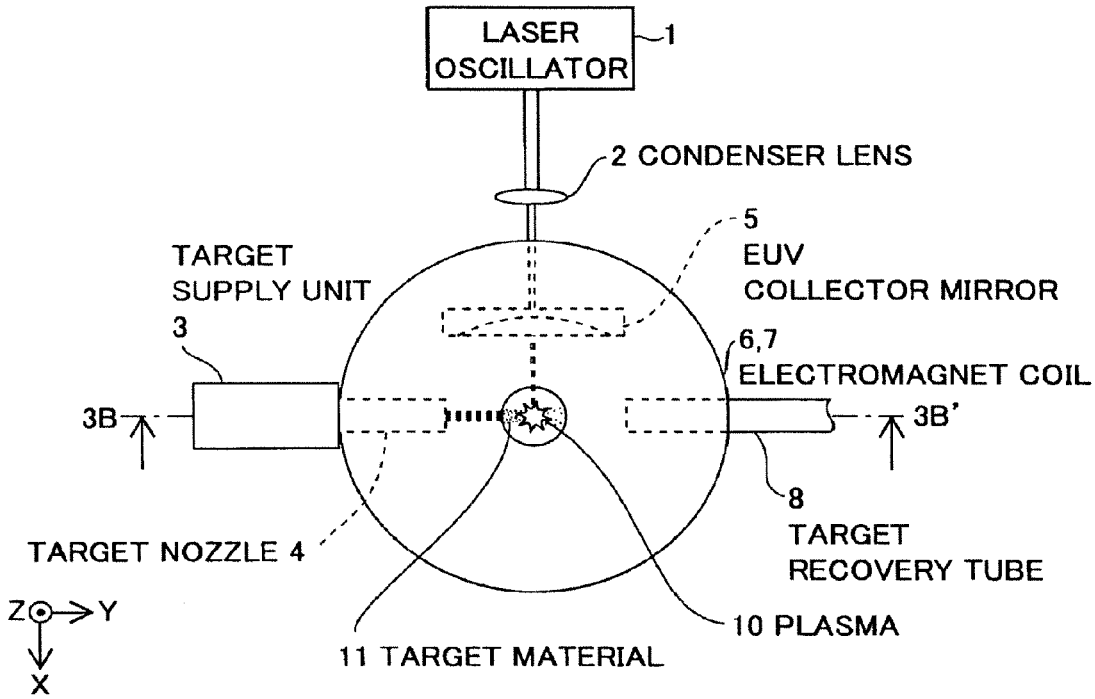
FIGS. 3A and 3B show a configuration of an extreme ultra violet light source device according to the second embodiment of the present invention.
Figure 3B:
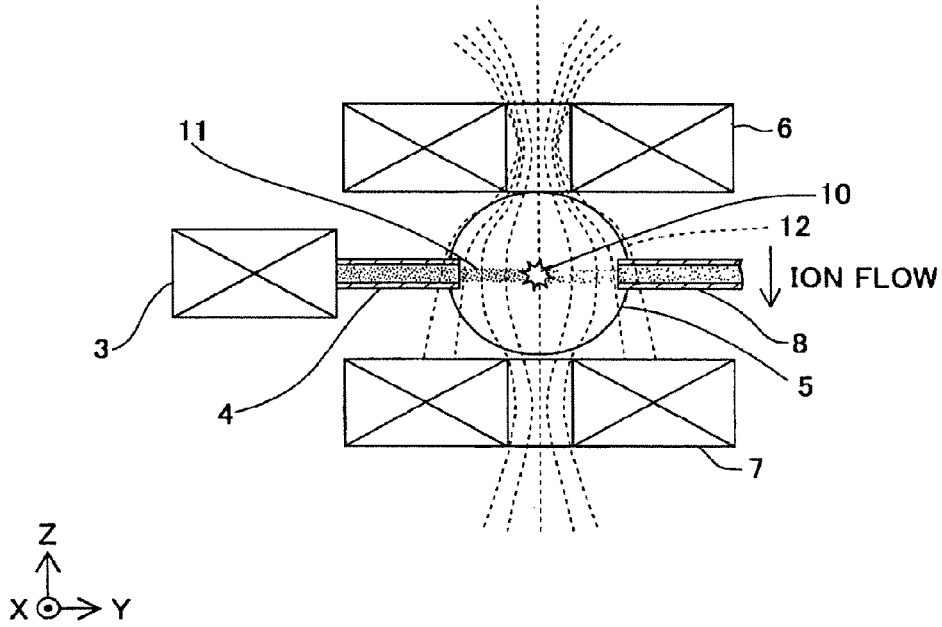

Next, an extreme ultra violet light source device according to the second embodiment of the present invention will be explained by referring to FIGS. 3A and 3B. FIG. 3A is a schematic view showing the extreme ultra violet light source device according to the embodiment, and FIG. 3B is a sectional view along 3B-3B' shown in FIG. 3A.

In the embodiment, the positions of the target nozzle 4 and the target recovery tube 8 are changed compared to the configuration shown in FIG. 1. That is, the target nozzle 4 and the target recovery tube 8 are located between the electromagnets 6 and 7 in the horizontal direction as shown in FIGS. 3A and 3B. The positions and orientation of the target nozzle 4 and the target recovery tube 8 are not especially limited as long as the target material 1 injected from the target nozzle 4 can pass the plasma emission point and avoid interference with other components including the EUV collector mirror 5 and the electromagnets 6 and 7. However, in order to reduce the collision with ions, etc. led out by the action of the asymmetric magnetic field, for example, those components are desirably located such that the central axis of the target nozzle 4 and the target recovery tube 8 is substantially perpendicular to the central axis of the lines of magnetic flux 12 (Z direction), that is, within the XY plane. Further, in order to improve the EUV light generation efficiency, the target nozzle 4 and the laser oscillator 1 are desirably located such that the flow of the target material 11 (in the Y direction in FIGS. 3A and 3B) and the laser beam (in the X direction in FIGS. 3A and 3B) is substantially perpendicular to each other.

In the embodiment, advantages in locating the central axis of the target nozzle 4 and the target recovery tube 8 to be substantially perpendicular to the central axis of the lines of magnetic flux 12 are as follows.

The ions and so on emitted from the plasma 10 collide with the components located around and promote the deterioration of the component themselves. Further, the ions and so on collide with the surrounding components and sputter their surfaces, and thereby, new contaminant (sputter material) is produced. The sputter material adheres to the reflection surface of the EUV collector mirror 5 and causes damage on the mirror and reduction in the reflectance. Accordingly, in the embodiment, the target nozzle 4 and the target recovery tube 8 are out of the passage of the ions led out by the action of the asymmetric magnetic field. Thereby, the deterioration of the target nozzle 4 and the target recovery tube 8 can be suppressed, and the life can be made longer. Further, the production of new contaminant can be suppressed, and the reduction in use efficiency of EUV light can be prevented.

Furthermore, in the embodiment, since no component is located in the passage of the ions led out by the action of the asymmetric magnetic field, i.e., in the region between the central openings of the electromagnets 6 and 7, the obstruction to the ion flow no longer exists and the ejection speed of ions can be improved. Accordingly, even when the EUV light is generated at a high repetition frequency, it becomes possible to prevent the ions from staying near the plasma emission point and suppress rise of the concentration thereof. Consequently, the absorption of EUV light by the target gas is suppressed, and thereby, the reduction in generation efficiency of EUV light can be suppressed.

In FIGS. 3A and 3B, the target nozzle 4 is deeply inserted between the electromagnets 6 and 7 such that the target material 11 injected from the target nozzle 4 reliably passes the optical path of the laser beam. However, a part or the entire of the target nozzle 4 may be located out of the electromagnets 6 and 7 as long as the position of the target material 1 can be stabilized.

Figure 4A:
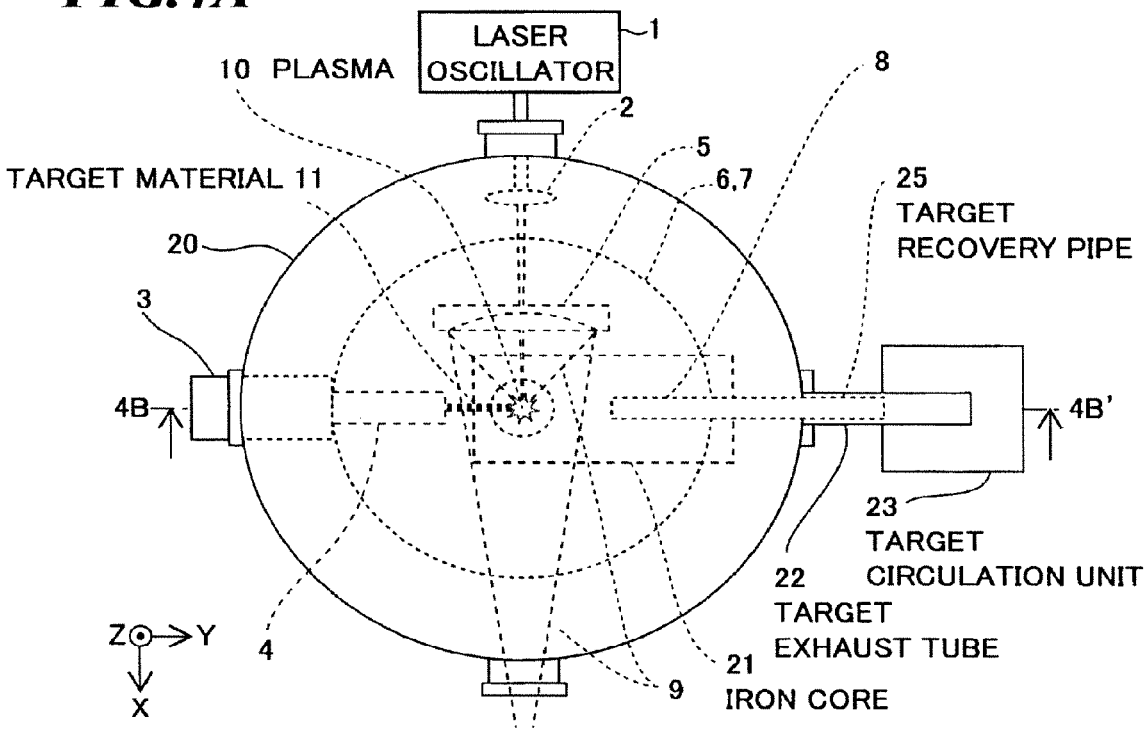
FIGS. 4A and 4B show a configuration of an extreme ultra violet light source device according to the third embodiment of the present invention.
Figure 4B:
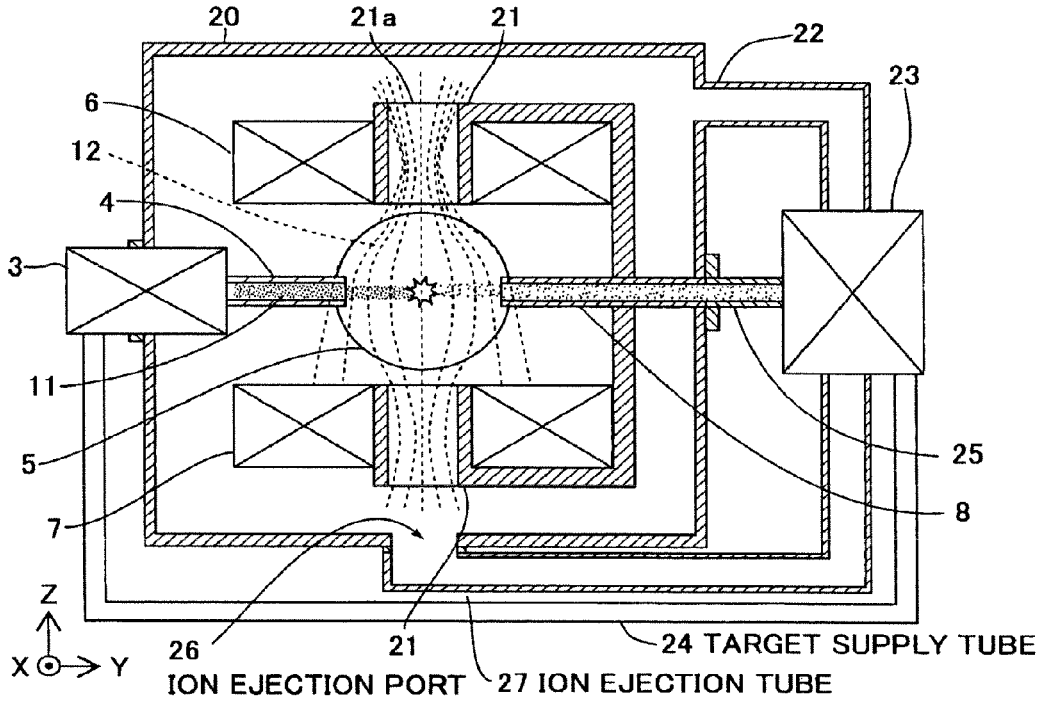

Next, an extreme ultra violet light source device according to the third embodiment of the present invention will be explained by referring to FIGS. 4A and 4B. FIG. 4A is a schematic view showing the extreme ultra violet light source device according to the embodiment, and FIG. 4B is a sectional view along the dashed-dotted line 4B-4B' shown in FIG. 4A.

In the extreme ultra violet light source device according to the embodiment, apart of the constituent components shown in FIGS. 3A and 3B is located within the vacuum chamber 20. That is, the condenser lens 2, a part of the target supply unit 3, the target nozzle 4, the EUV collector mirror 5, the electromagnets 6 and 7, and the target recovery tube 8 of the constituent components are located within the vacuum chamber 20. The operation of and the arrangement relationship among these constituent components are the same as those in the second embodiment. Further, the extreme ultra violet light source device according to the embodiment further has an iron core 21, a target exhaust tube 22, a target circulation unit 23, a target supply tube 24, a target recovery pipe 25, and an ion ejection tube 27 connected to an ion ejection port 26 in addition to the configuration.

In the embodiment, the EUV collector mirror 5 is formed such that its reflection surface is a part of a spheroid. The EUV collector mirror 5 is provided such that the first focus of the spheroid coincides with the plasma emission point, and the EUV light incident from the plasma emission point to the EUV collector mirror 5 is reflected to be collected to the second focus of the spheroid. FIG. 4A shows optical paths 9 of the incident light to the EUV collector mirror 5 and reflection light from the EUV collector mirror 5.

The iron core 21 is inserted into the central opening of each of the electromagnets 6 and 7. Because of the existence of the iron core 21, a part of lines of magnetic flux near the electromagnets 6 and 7 is absorbed into the iron core 21. Accordingly, the magnetic flux density near the plasma emission point becomes higher and the magnetic flux density near the central openings of the electromagnets 6 and 7 becomes lower, and the mirror ratio becomes smaller. Thereby, as previously explained by referring to FIGS. 2A and 2B, the apex angles of the loss cones in the asymmetric magnetic field become larger, and therefore, it becomes possible to increase a number of the charged particles that can be led out of the magnetic field. Further, as shown in FIG. 4B, an opening 21*a* for ejecting ions, etc. led by the asymmetric magnetic field is formed in the central region of the iron core 21.

The target exhaust tube 22 is a path for ejecting the target material remaining within the vacuum chamber 20 out of the vacuum chamber 20. Further, the target circulation unit 23 is a unit for recycling the recovered target material and includes a suction driving source (suction pump), a refinement mechanism of target material, and a pressure feed driving source (pressure feed pump). The target circulation unit 23 suctions the target material via the target exhaust tube 22 to recover the target material, refines the material in the refinement mechanism, and pressure-feeds it to the target supply unit 3 via the target supply tube 24.

The target recovery pipe 25 transports the target material recovered by the target recovery tube 8 to the target circulation unit 23. The recovered target material is refined in the target circulation unit 23 and reused.

As shown in FIG. 4B, the ion ejection port 26 is formed in the wall of the vacuum chamber 20 facing the central opening of the electromagnet 7 or the opening of the iron core formed in a side thereof inserted into the electromagnet 7. The flying object including the ions emitted from the plasma and led out of the electromagnet 7 by the action of the asymmetric magnetic field passes through the ion ejection port 26 formed at the downstream of its flow, and is ejected out of the vacuum chamber 20. Furthermore, the ions, etc. are transported to the target circulation unit 23 via the ion ejection tube 27, and refined and recycled therein.

Figure 5:
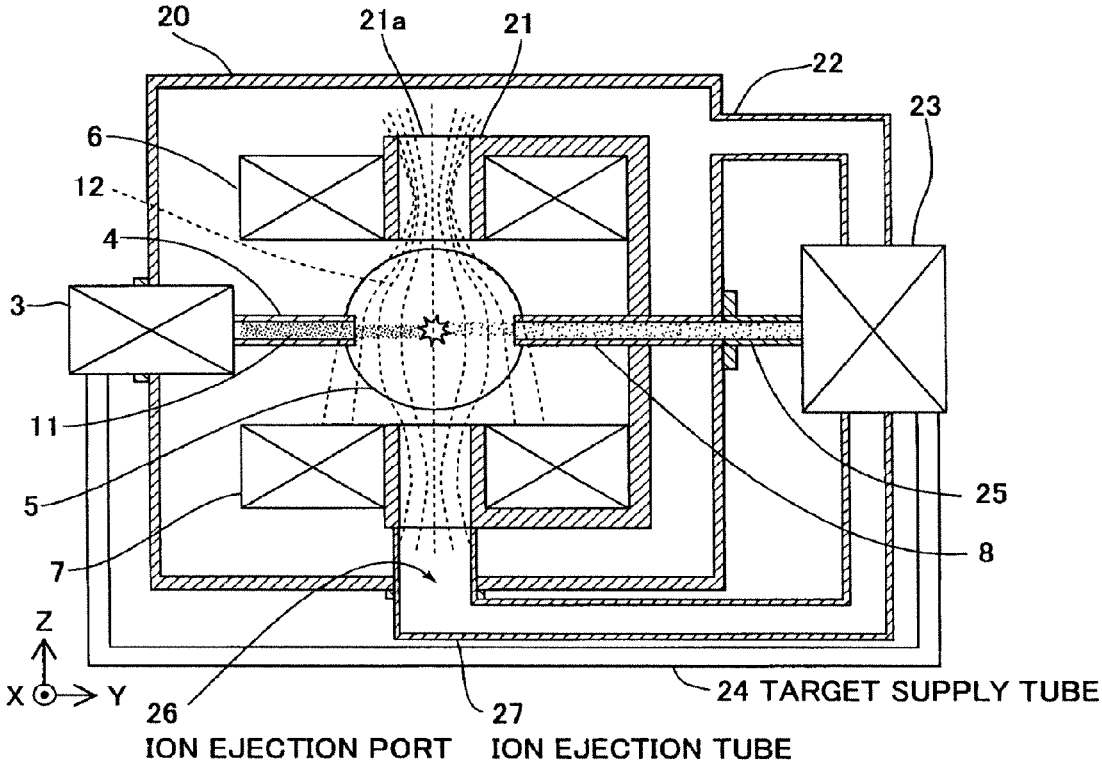
FIG. 5 shows a modified example of the extreme ultra violet light source device according to the third embodiment of the present invention.

FIG. 5 shows a modified example of the extreme ultra violet light source device shown in FIGS. 4A and 4B. In the modified example, an ion ejection tube 27*a* is provided in place of the ion ejection tube 27 shown in FIGS. 4A and 4B. As shown in FIG. 5, the ion ejection tube 27*a* is formed to join the central opening of the electromagnet 7 or the opening of the iron core 21 formed in a side thereof inserted into the electromagnet 7, within the vacuum chamber 20. Thereby, the flying object including the ions emitted from the plasma and led out of the electromagnet 7 by the action of the asymmetric magnetic field passes through the ion ejection tube 27*a* formed at the downstream of its flow, and is efficiently ejected out of the vacuum chamber 20.

As described above, according to the embodiment, the magnetic flux density near the plasma emission point is made higher and the mirror ratio is made smaller by inserting the iron core 21 in the electromagnets 6 and 7, and thereby, the ions emitted from the plasma can be efficiently led out of the electromagnets 6 and 7.

Further, according to the embodiment, the opening is provided in the direction of lines of magnetic flux from higher toward lower magnetic field density, and thereby, the ions led out of the electromagnet 7 by the action of the asymmetric magnetic field can be reliably ejected out of the vacuum chamber.

Furthermore, according to the embodiment, unwanted material (the target material or its ion) is collected via the target exhaust tube 22, the target recovery tube 8, and the ion ejection tube 27, and thereby, the contamination within the vacuum chamber 20 can be prevented and the degree of vacuum can be made higher. In addition, by reusing the recovered unwanted material, the operation cost of the EUV light source device can be reduced.

Although the iron core 21 inserted into the electromagnets 6 and 7 is integrated in FIGS. 4A and 4B, iron cores separated from each other may be inserted into the centers of the respective coils.

Figure 6A:
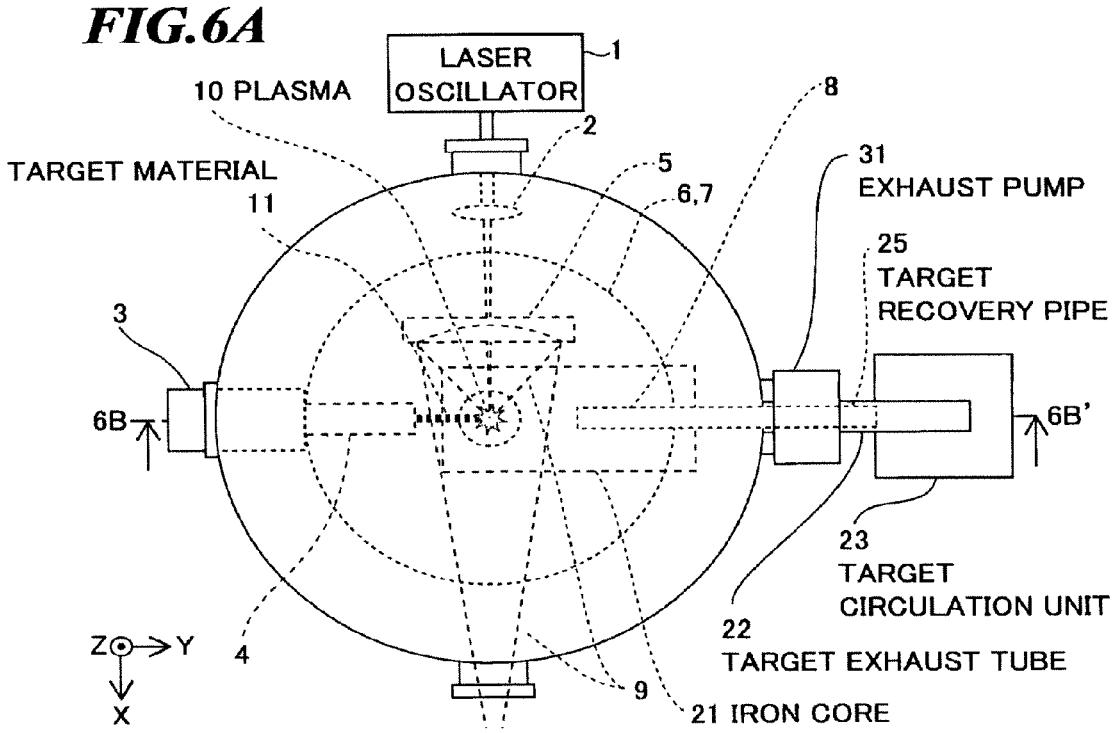
FIGS. 6A and 6B show a configuration of an extreme ultra violet light source device according to the fourth embodiment of the present invention.

Next, an extreme ultra violet light source device according to the fourth embodiment of the present invention will be explained by referring to FIGS. 6A and 6B. FIG. 6A is a schematic view showing the extreme ultra violet light source device according to the embodiment, and FIG. 6B is a sectional view along the dashed-dotted line 6B-6B' shown in FIG. 6A.

Figure 6B:
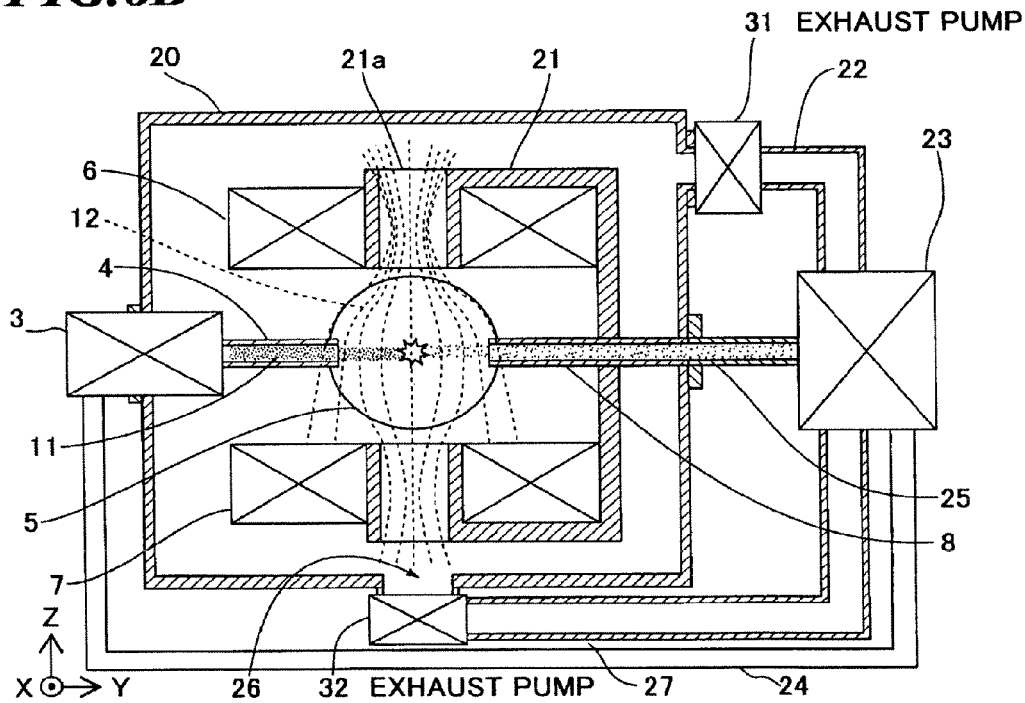

As shown in FIGS. 6A and 6B, the extreme ultra violet light source device according to the embodiment further has exhaust pumps 31 and 32 in addition to the extreme ultraviolet light source device shown in FIGS. 4A and 4B. Other configuration is the same as that shown in FIGS. 4A and 4B.

The exhaust pump 31 is provided to the target exhaust tube 22 and promotes the ejection of the target material remaining within the vacuum chamber 20.

Further, the exhaust pump 32 is provided to the ion ejection tube 27 and promotes the movement of ions led out by the action of the asymmetric magnetic field.

According to the embodiment, since the interior of the vacuum chamber 20 is exhausted not only by the suction driving source provided to the target circulation unit 23 but also using the exhaust pumps 31 and 32, the unwanted material (the target material or its ion) existing within the vacuum chamber 20 can be efficiently ejected. Therefore, the EUV use efficiency can be improved by preventing contamination within the chamber and making the degree of vacuum within the chamber higher.

Figure 7:
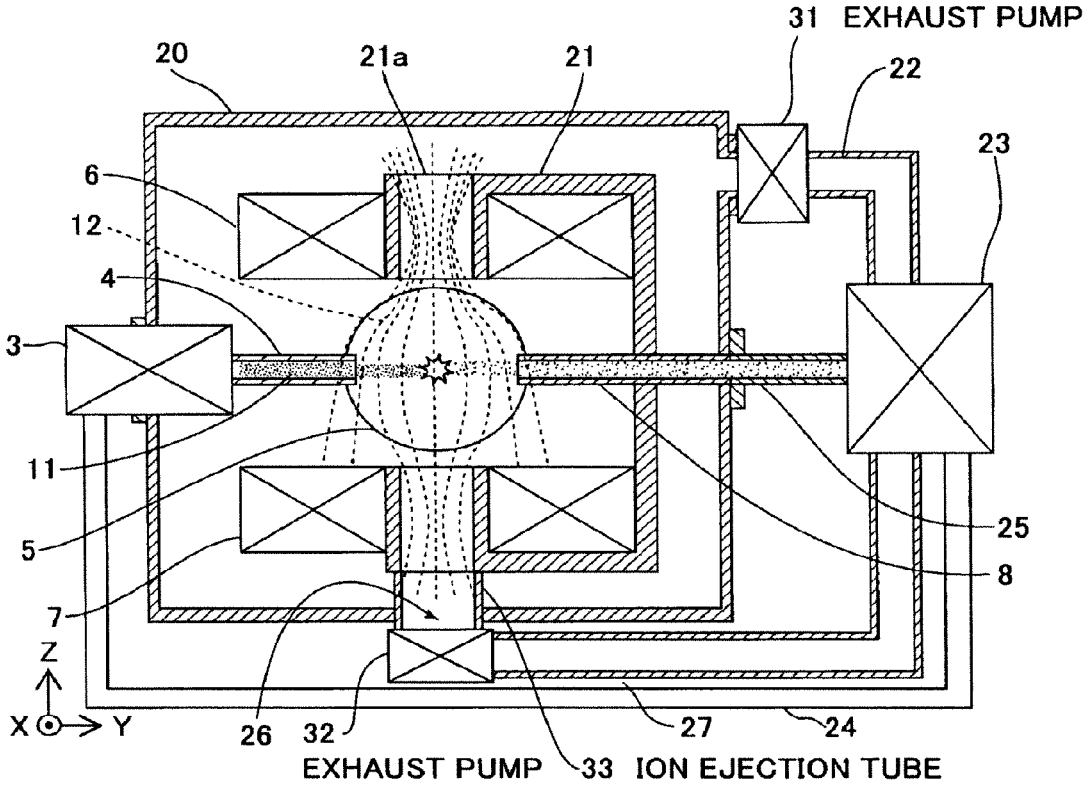
FIG. 7 shows a modified example of the extreme ultra violet light source device according to the fourth embodiment of the present invention.

FIG. 7 shows a modified example of the extreme ultra violet light source device shown in FIGS. 6A and 6B. In the modified example, the exhaust pump 32 is connected to an ion ejection tube 33. The ion ejection tube 33 is formed to join the central opening of the electromagnet 7 or the opening of the iron core 21 formed in a side thereof inserted into the electromagnet 7, within the vacuum chamber 20. Thereby, the flying object including the ions emitted from the plasma and led out of the electromagnet 7 by the action of the asymmetric magnetic field passes through the ion ejection tube 33 joined at the downstream of its flow and is suctioned by the exhaust pump 32, and is efficiently ejected out of the vacuum chamber 20.

Figure 8:
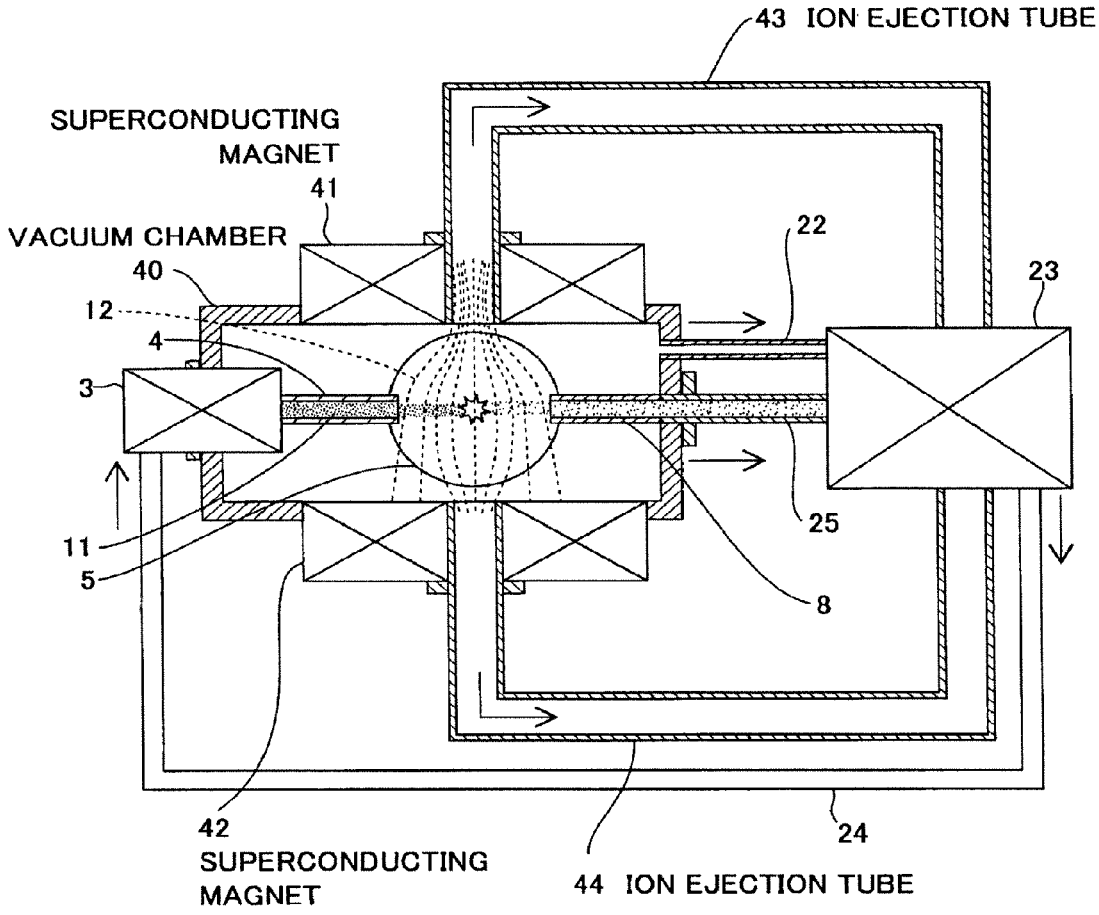
FIG. 8 is a sectional view showing a configuration of an extreme ultra violet light source device according to the fifth embodiment of the present invention.

Next, an extreme ultra violet light source device according to the fifth embodiment of the present invention will be explained by referring to FIG. 8. FIG. 8 is a sectional view showing a configuration of the extreme ultra violet light source device according to the embodiment. The embodiment is characterized by forming an asymmetric magnetic field by employing superconducting coils in place of electromagnetic coils.

As shown in FIG. 8, the extreme ultra violet light source device according to the embodiment has a vacuum chamber 40, superconducting coils 41 and 42, ion ejection tubes 43 and 44 in place of the vacuum chamber 20, the electromagnets 6 and 7, and the iron core 21 as shown in FIGS. 4A and 4B. Other configuration is the same as that shown in FIGS. 4A and 4B.

The superconducting coils 41 and 42 are coils formed of a superconducting material, and generate superconducting phenomena and form strong magnetic fields when electric current is supplied thereto. In the embodiment, the magnetic field formed by the superconducting coil 41 is made stronger than that formed by the superconducting magnet 42, and thereby, an asymmetric magnetic field with higher magnetic flux density at the upper part in FIG. 8 and lower magnetic flux density at the lower part in FIG. 8 is formed. Since there is no need to provide an iron core when the superconducting coils are used, the superconducting coils 41 and 42 may be provided on and under the vacuum chamber 40 for also serving as flanges (lids). Thereby, the size of the vacuum chamber 40 can be made smaller.

Further, the ion ejection tubes 43 and 44 are respectively connected to the openings of the superconducting coils 41 and 42 that also serve as flanges. Thereby, the ions moving by the action of the asymmetric magnetic field can be reliably ejected to the outside of the vacuum chamber 40. Note that two ion ejection tubes are not necessarily provided as long as at least the ion ejection tube 44, that is, the flange at a side with lower magnetic flux density) is provided. This is because a large number of ions are led out in the direction of the ion ejection tube 44 by the action of the asymmetric magnetic field.

In the embodiment, exhaust pumps may be provided to the respective ion ejection tubes 43 and 44 as is the case of the fourth embodiment.

Further, in place of superconducting magnets used in the embodiment, permanent magnets with openings formed at the centers may be used. In this case, the magnets may also serve as the flanges of the vacuum chamber.

Next, asymmetric magnetic field forming means that is applied to the extreme ultra violet light source devices according to the first to fifth embodiments of the present invention will be explained.

Figure 9A:
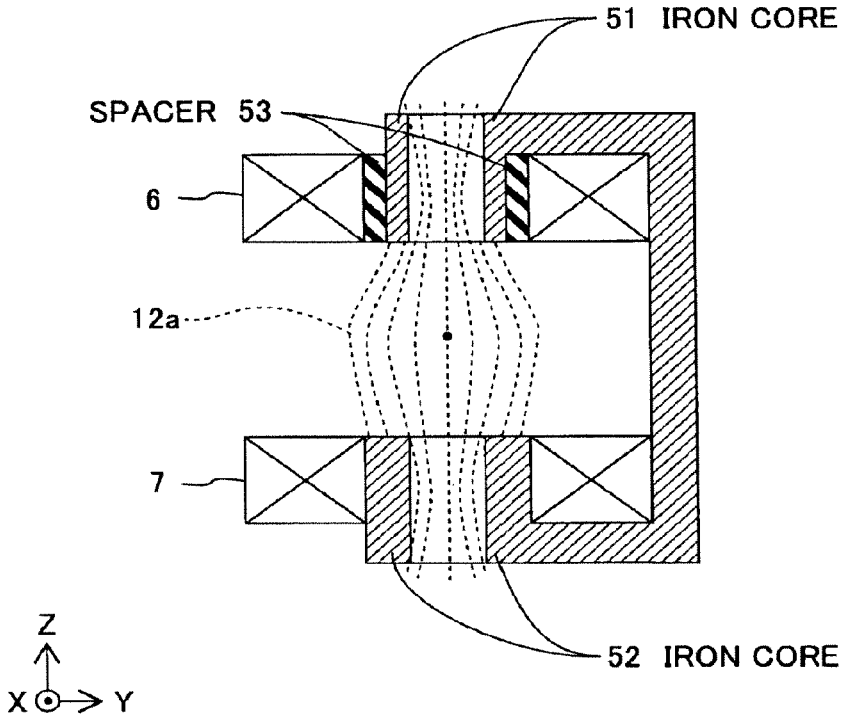
FIGS. 9A and 9B are diagrams for explanation of the first configuration of asymmetric magnetic field forming means.
Figure 9B:
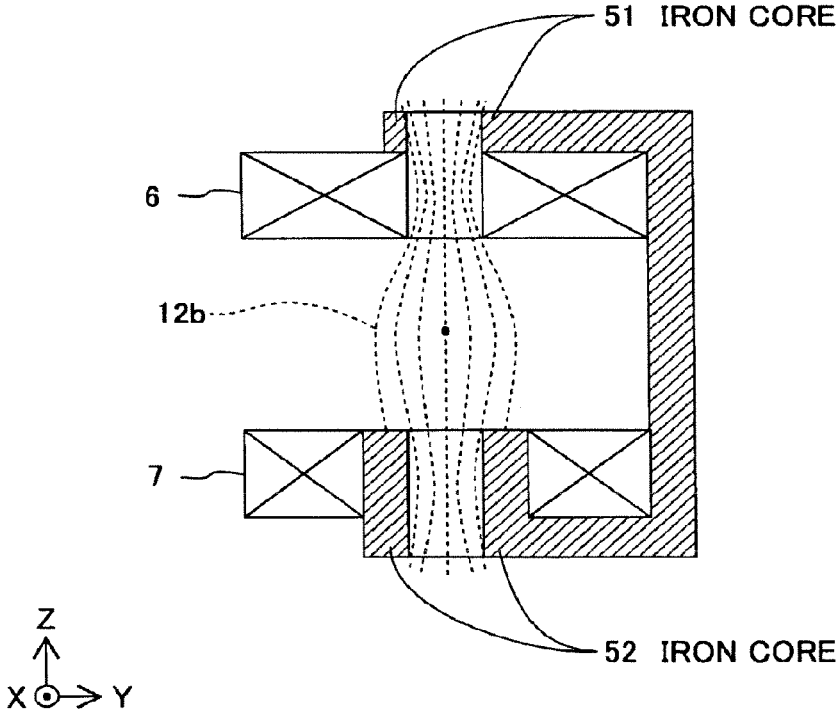

FIGS. 9A and 9B are diagrams for explanation of the first configuration of the asymmetric magnetic field forming means.

As shown in FIG. 9A, an iron core 51 is inserted into the electromagnetic coil 6, and an iron core 52 that has a larger outer diameter than that of the iron core 51 is inserted into the electromagnetic coil 7. Further, a spacer 53 is inserted between the electromagnetic coil 6 and the iron core 51 such that the center axis thereof may not be out of alignment. Since the iron core 51 and the iron core 52 are equal in inner diameter, the iron core 52 has a larger thickness.

Thus, by making the outer diameter of the iron core 52 larger than that of the iron core 51, the magnetic flux density at a side of the electromagnetic coil 7 becomes lower than the magnetic flux density at a side of the electromagnetic coil 6. As a result, an asymmetric magnetic field as shown by lines of magnetic flux 12*a* is formed.

Although the iron core 51 and the iron core 52 are integrated in the configuration, iron cores separated from each other may be inserted into the coils, respectively.

Further, although iron cores different from each other in shape and/or size are inserted into both electromagnetic coils, an asymmetric magnetic field may be formed by inserting an iron core into only one electromagnetic coil (e.g., the electromagnetic coil 7) to weaken the magnetic flux density near the central opening of the electromagnetic coil 7 as shown in FIG. 9B. In FIG. 9B, the iron core is provided outside of the electromagnetic coil 6 but not inserted into the central opening of the electromagnetic coil 6. Accordingly, high magnetic flux density can be obtained also near the central part of the central opening of the electromagnetic coil 6. On the other hand, the iron core 52 is inserted into the electromagnetic coil 7, and thereby, a part of the lines of magnetic flux near the electromagnetic coil 7 is absorbed into the iron core 52. As a result, the magnetic flux density near the plasma emission point becomes higher and the magnetic flux density near the central part of the central opening of the electromagnetic coil 7 becomes lower, and thus, the mirror ratio becomes smaller. Thereby, the apex angle of the loss cone in the asymmetric magnetic field becomes larger at a side of the electromagnetic coil 7, and the charged particles that can be led out of the magnetic field can be increased.

Figure 10:
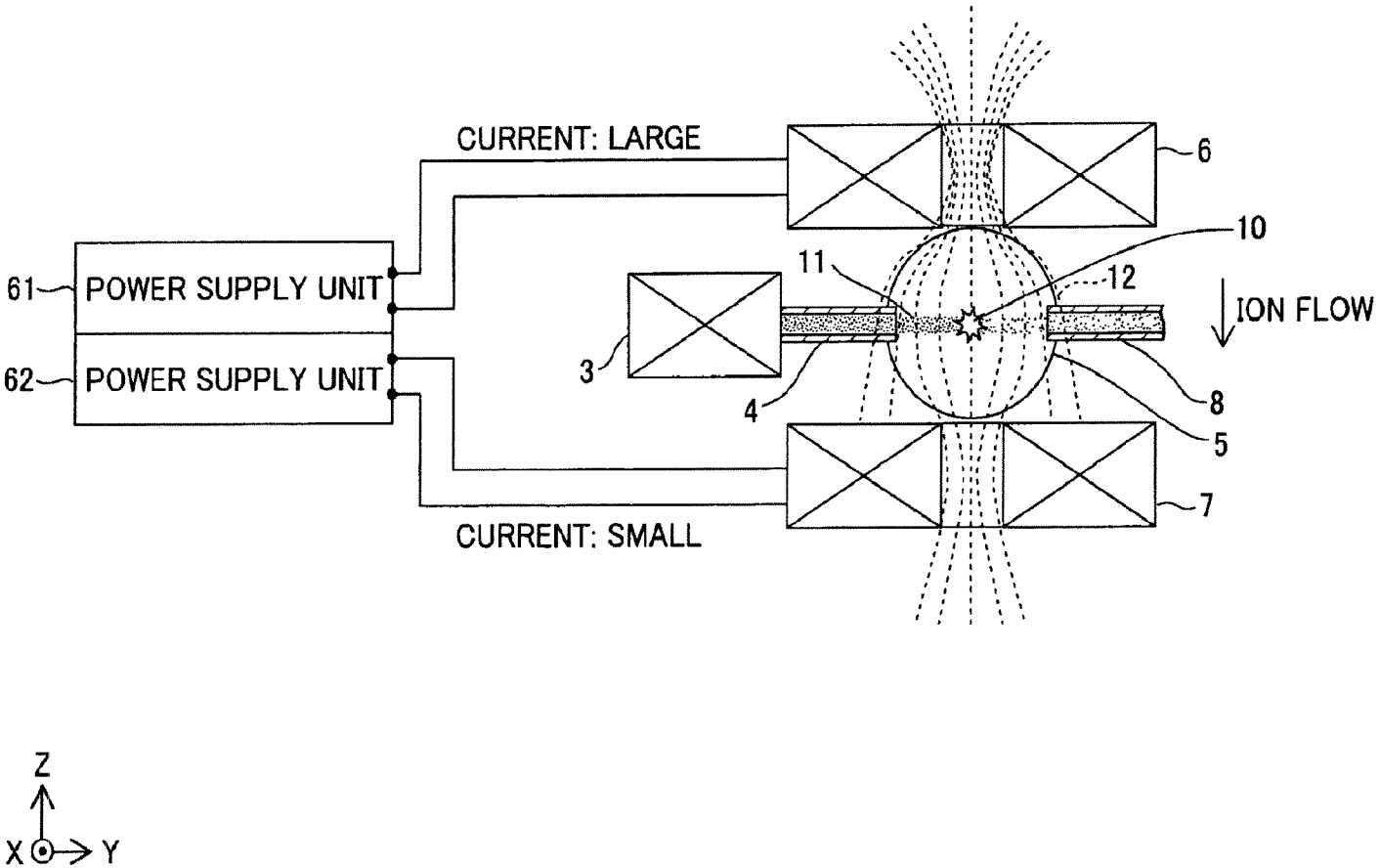
FIG. 10 is a diagram for explaining the second configuration of the asymmetric magnetic field forming means.

FIG. 10 is a diagram for explanation of the second configuration of the asymmetric magnetic field forming means.

As shown in FIG. 10, a power supply unit 61 is connected to the electromagnetic coil 6 and a power supply unit 62 is connected to the electromagnetic coil 7. The current flowing in the electromagnetic coil 6 is made smaller than the current flowing in the electromagnetic coil 7. Thereby, the magnetic field generated by the electromagnetic coil 7 becomes weaker than the magnetic field generated by the electromagnetic coil 6, and therefore, the magnetic flux density becomes relatively lower, and an asymmetric magnetic field as shown by the lines of magnetic flux 12 is formed.

According to the second configuration, the power supply units are independently connected to the electromagnetic coils 6 and 7, respectively, and thereby, the mirror ratio at the electromagnetic coil 6 side and the mirror ratio at the electromagnetic coil 7 side can be independently controlled. Therefore, the ejection speed of ions by the action of the asymmetric magnetic field can be controlled relatively easily.

Figure 11:
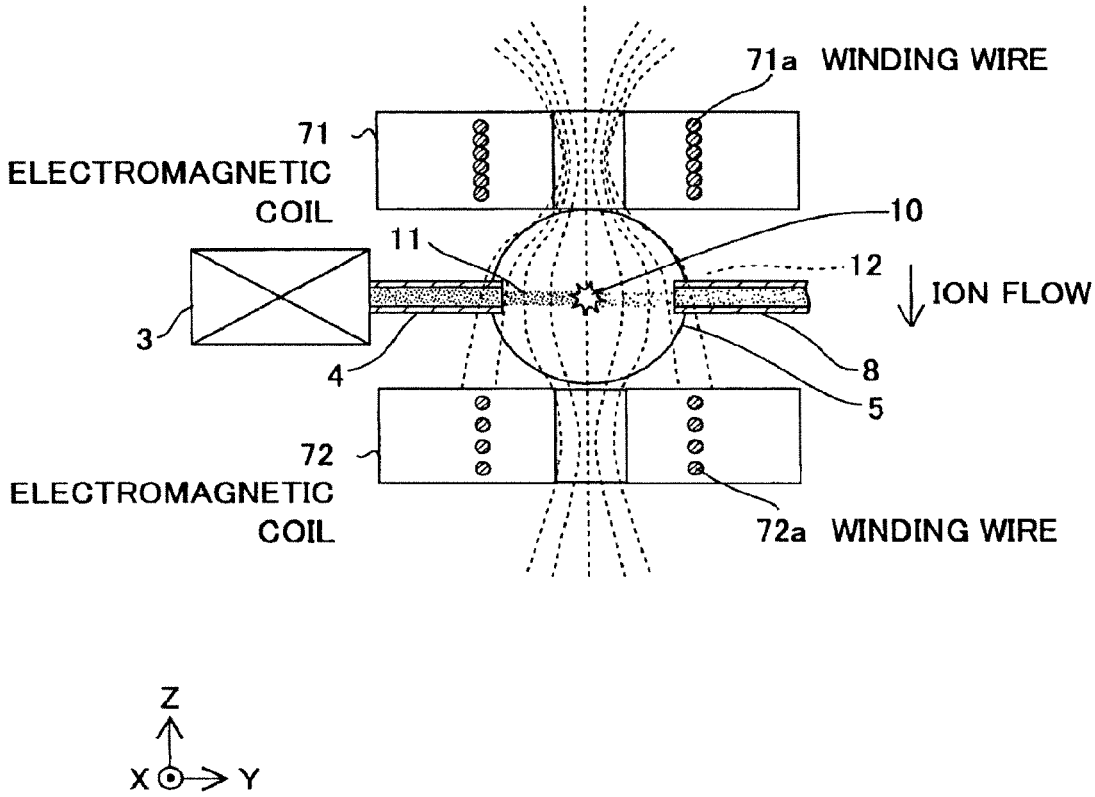
FIG. 11 is a diagram for explaining the third configuration of the asymmetric magnetic field forming means.

FIG. 11 is a diagram for explanation of the third configuration of the asymmetric magnetic field forming means.

As shown in FIG. 11, the number of turns of a winding wire 71*a* in an electromagnetic coil 71 is larger than that of a winding wire 72*a* in an electromagnetic coil 72. When electric currents having the same magnitude respectively flows in the electromagnetic coils 71 and 72, the magnetic field generated by the electromagnetic coil 72 having the smaller number of turns is weaker than the magnetic field generated by the electromagnetic coil 71, and the magnetic flux density relatively becomes lower and an asymmetric magnetic field as shown by the lines of magnetic flux 12 is formed.

Figure 12:
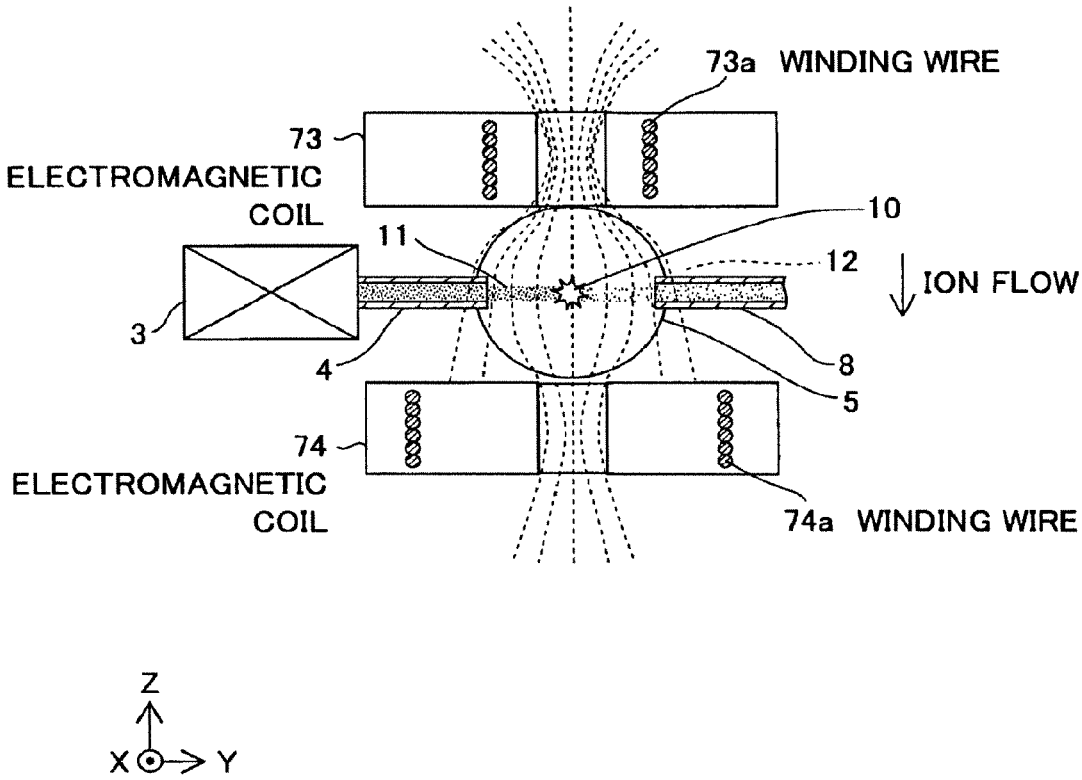
FIG. 12 is a diagram for explaining the fourth configuration of the asymmetric magnetic field forming means.

FIG. 12 is a diagram for explanation of the fourth configuration of the asymmetric magnetic field forming means.

As shown in FIG. 12, the diameter of turns of a winding wire 73*a* in an electromagnetic coil 73 is smaller than that of a winding wire 74*a* in an electromagnetic coil 74. When electric currents having the same magnitude respectively flow in the electromagnetic coils 73 and 74 to generated magnetic fields, the flux density at a side of the electromagnetic coil 74 having the larger diameter is relatively lower than the flux density at a side of the electromagnetic coil 73. Consequently, an asymmetric magnetic field as shown by the lines of magnetic flux 12 is formed.

Figure 13:
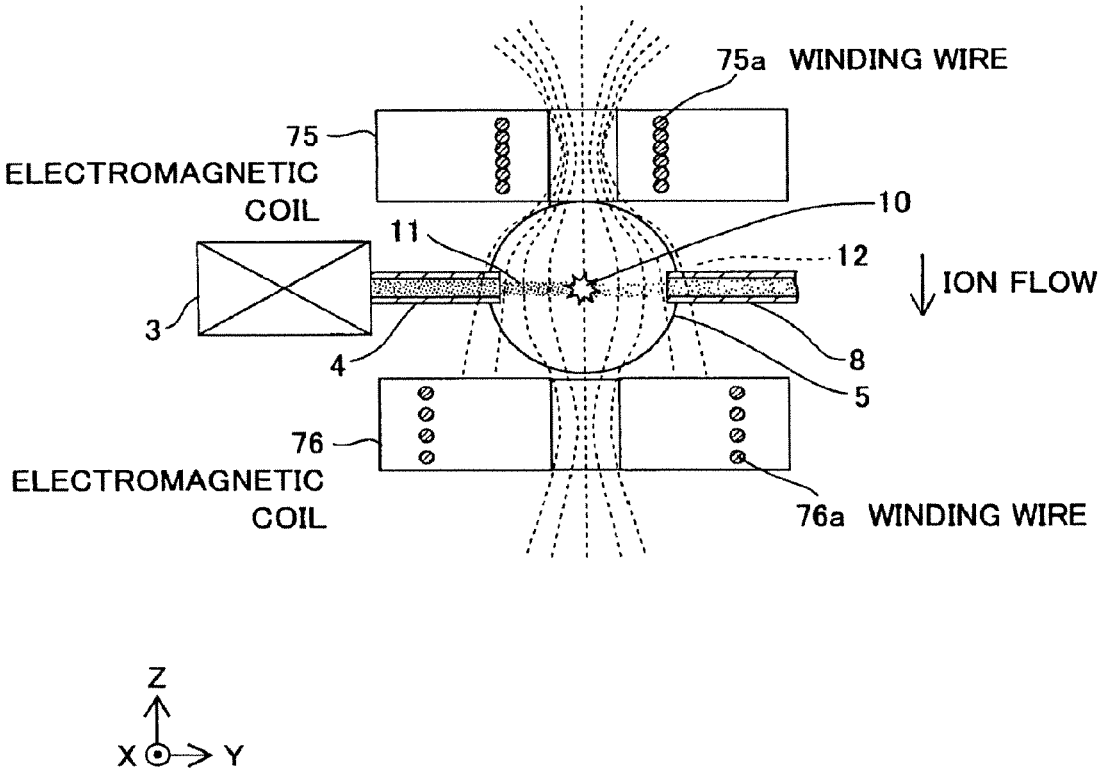
FIG. 13 is a diagram for explaining the fifth configuration of the asymmetric magnetic field forming means.

FIG. 13 is a diagram for explanation of the fifth configuration of the asymmetric magnetic field forming means.

As shown in FIG. 13, the number of turns of a winding wire 76*a* in an electromagnetic coil 76 is smaller than that of a winding wire 75*a* in an electromagnetic coil 75, and the diameter of turns of the winding wire 76*a* is larger than that of a winding wire 75*a*. When electric currents having the same magnitude respectively flows in the electromagnetic coils 75 and 76, the magnetic flux density at the electromagnetic coil 74 side is lower than that at the electromagnetic coil 76 side, and an asymmetric magnetic field as shown by the lines of magnetic flux 12 is formed.

Thus, plural elements (a number of turns, a diameter of turns of a winding wire, and so on) that form the electromagnetic coil may be combined.

Figure 14:
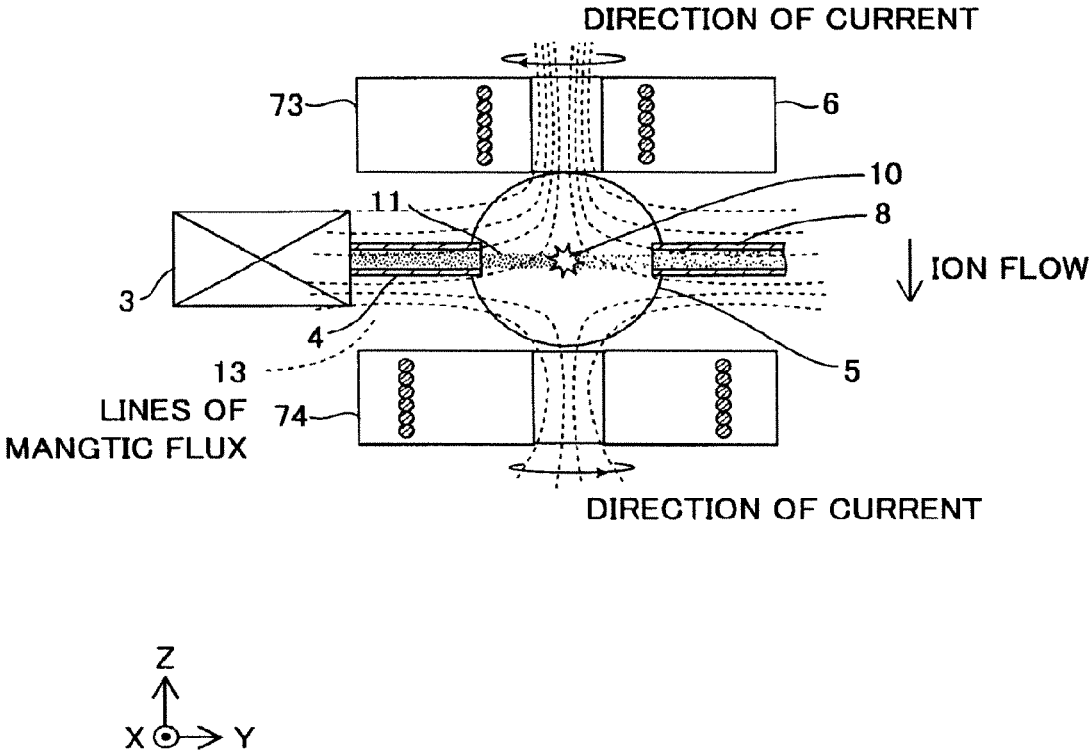
FIG. 14 is a diagram for explaining the sixth configuration of the asymmetric magnetic field forming means.

FIG. 14 is a diagram for explanation of the sixth configuration of the asymmetric magnetic field forming means.

As shown in FIG. 14, electric currents having the same magnitude respectively flows in the electromagnetic coils 73 and 74 in the opposite direction. Thereby, as shown by lines of magnetic flux 13, asymmetric magnetic fields that repel each other are formed between the electromagnetic coils 73 and 74. Since the electromagnetic coils 73 and 74 are different in diameter of turns of winding wires (the electromagnetic coil 74 is larger), the magnetic flux density generated by the electromagnetic coil 74 is lower than that generated by the electromagnetic coil 73. Accordingly, the center of the asymmetric magnetic field (the region where the magnetic flux density is the lowest) shifts from the center of the two electromagnetic coils 73 and 74 toward a side of the electromagnetic coil 74. Therefore, in the case where the plasma emission point is set to the center of the electromagnetic coils 73 and 74, the ions emitted from the plasma are guided in the direction of lines of magnetic flux toward the lower magnetic flux density, and they can be promptly moved from the vicinity of the plasma emission point and led outside.

Since the magnetic fluxes repelling each other densely exist near the center of the magnetic fields, the advance of ions moving in parallel to the Y-axis is inhibited. Therefore, there is little possibility that ions fly in the direction of the EUV collector mirror 5.

Although the electromagnetic coils 73 and 74 as shown in FIG. 12 are used in the sixth configuration, the electromagnetic coils 71 and 72 as shown in FIG. 11 or the electromagnetic coils 75 and 76 as shown in FIG. 13 may be used. Alternatively, the magnitude of current flowing in the electromagnetic coils may be varied while using the same electromagnetic coils.

Figure 15:
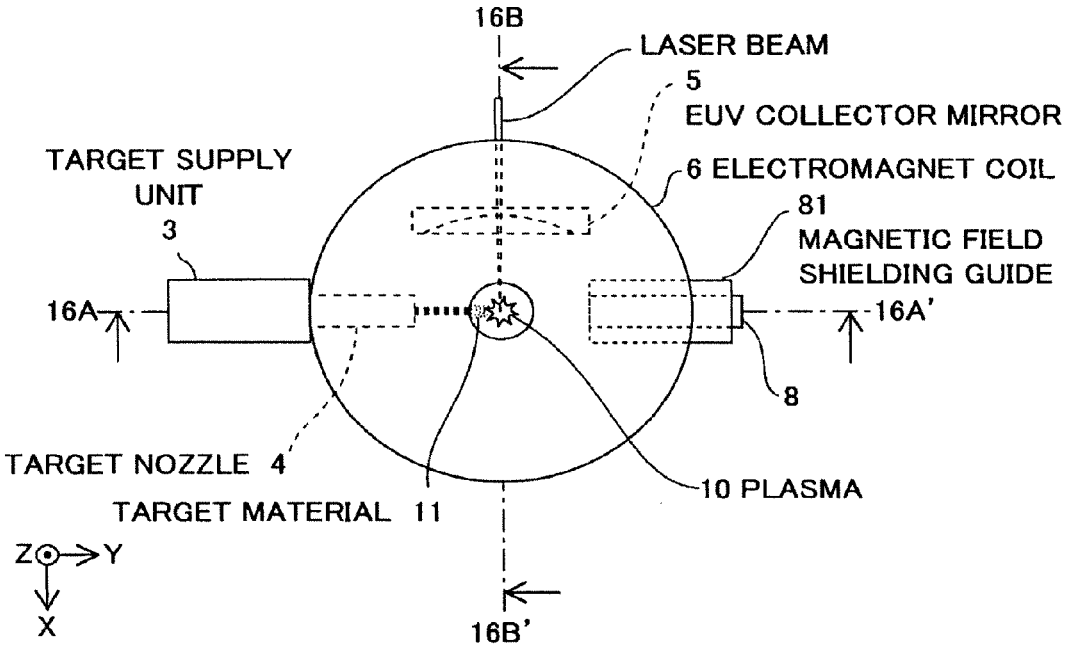
FIG. 15 is a diagram for explaining the seventh configuration of the asymmetric magnetic field forming means.
Figure 16A:
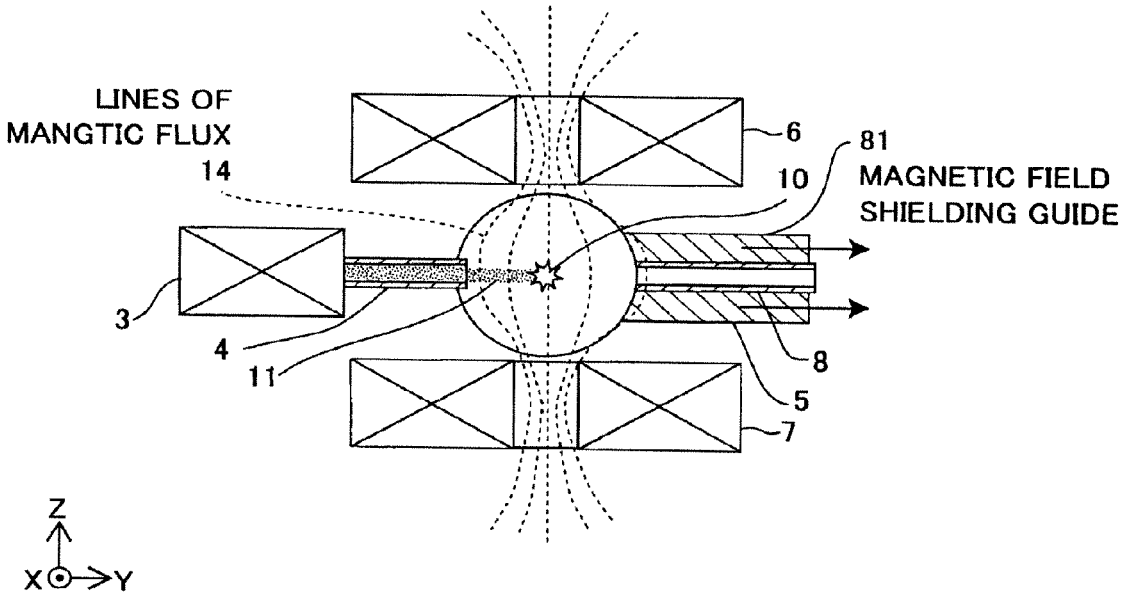
FIGS. 16A and 16B are diagrams for explaining the seventh configuration of the asymmetric magnetic field forming means.
Figure 16B:
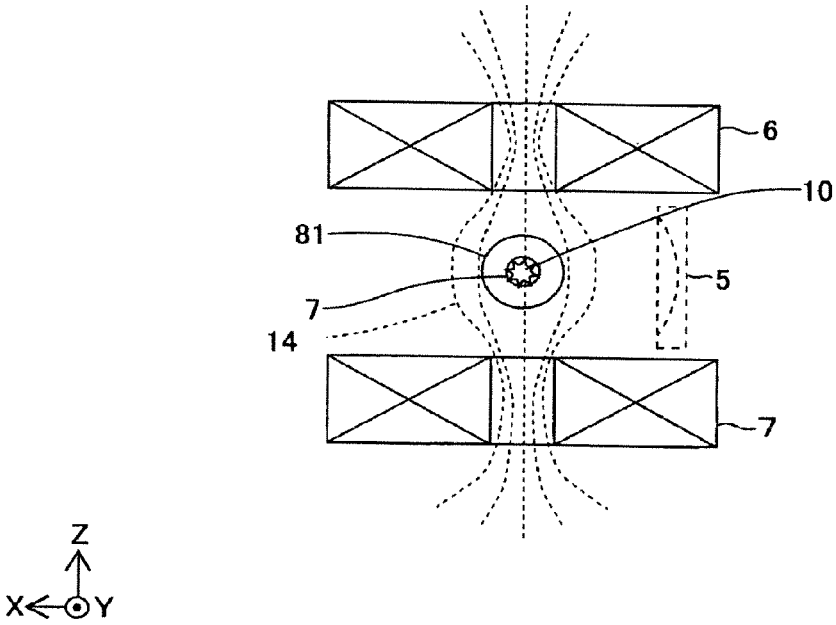

FIGS. 15, 16A, and 16B are diagrams for explanation of the seventh configuration of the asymmetric magnetic field forming means. In below, explanations will be made as to the case where the configuration is applied to the extreme ultra violet light source device as shown in FIGS. 3A and 3B. FIG. 16A shows a section along the dashed-dotted line 16A-16A' shown in FIG. 15, and FIG. 16B shows a section along the dashed-dotted line 16B-16B' shown in FIG. 15. In the configuration, an asymmetric magnetic field is formed by shielding a part of a mirror magnetic field formed by two magnets. The configuration may be applied not only to the case of using electromagnetic coils but also to the case of using superconducting magnets or permanent magnets.

As shown in FIGS. 15 and 16A, in the configuration, a part of a magnetic field formed by the electromagnets 6 and 7 is shielded by inserting a magnetic field shielding guide 81 between the electromagnet 6 and the electromagnet 7. The magnetic field shielding guide 81 is formed of a ferromagnetic material such as iron, cobalt, nickel, ferrite, or the like and magnetized in an opposite direction to the magnetic field generated by the electromagnets 6 and 7. Therefore, magnetic field lines hardly enter the magnetic field shielding guide 81 as a ferromagnetic material. Accordingly, a low magnetic flux density state, i.e., an asymmetric magnetic field is formed near the magnetic field shielding guide 81. Thereby, ions are forced toward the lower magnetic flux density, pass from the plasma emission point through the magnetic field shielding guide 81, and moves in the direction of arrows shown in FIG. 16A. Thus, the ions can be promptly led out.

Here, the shape and size of the magnetic field shielding guide 81 is not specifically limited, but the magnetic field shielding guide 81 may be formed in a tubular shape and the interior of the tube may be suctioned from the outside for allowing the ions to pass through. Further, in order to efficiently lead out the ions emitted from the plasma 10, it is desirable that the magnetic field shielding guide 81 is located as close to the plasma 10 as possible, and it is important that at least the optical path of the incident light to the EUV collector mirror 5 may not be inhibited.

In the case where the magnetic field shielding guide 81 is symmetrically located with respect to the YZ plane as shown in FIG. 16B, the asymmetric magnetic field formed thereby becomes a mirror magnetic field symmetric with respect to the YZ plane. That is, the ions emitted from the plasma are confined near the plasma emission point due to the confinement effect by the magnetic field. Thereby, most ions move in the Y direction through the magnetic field shielding guide 81 having low magnetic flux density or move along the Z-axis, and therefore, contamination and damage on the EUV collector mirror 5 by the ions can be suppressed.

Figure 17A:
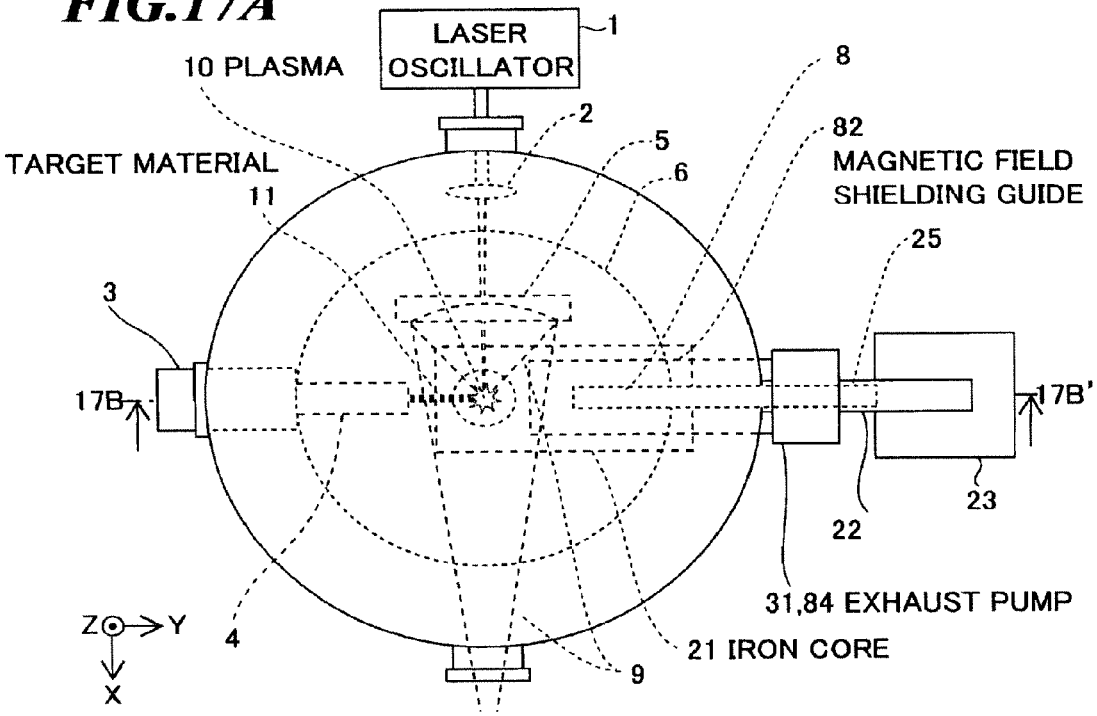
FIGS. 17A and 17B show an example of applying the above explained seventh configuration for forming an asymmetric magnetic field to an extreme ultra violet light source device having an exhaust system.
Figure 17B:
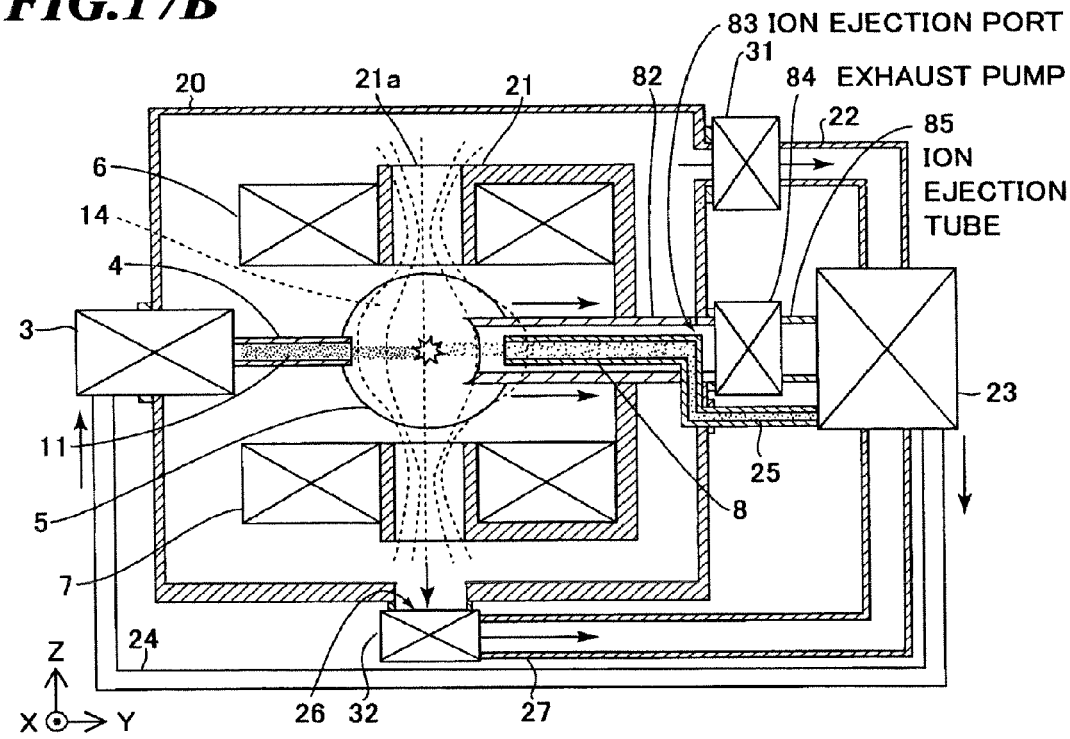

FIGS. 17A and 17B show an example of applying the above explained seventh configuration to an extreme ultra violet light source device having an exhaust system. FIG. 17B shows a section along the dashed-dotted line 17B-17B' shown in FIG. 17A.

The extreme ultra violet light source device shown in FIGS. 17A and 17B further has a magnetic field shielding guide 82, an exhaust pump 84 connected to an ion ejection port 83, and an ion ejection tube 85 compared to the extreme ultra violet light source device shown in FIGS. 6A and 6B. The material, configuration, and action of the magnetic field shielding guide 82 are the same as those of the above-explained magnetic field shielding guide 81 (FIGS. 16A and 16B). In FIGS. 17A and 17B, the route of the target recovery pipe 25 is slightly changed for avoiding the interference with the magnetic field shielding guide 82 and the exhaust system thereof.

As shown in FIG. 17B, the ion ejection port 83 is provided at the end of the magnetic field shielding guide 82. The ions forced in the direction toward the interior of the magnetic field shielding guide 82 by the action of the asymmetric magnetic field are promptly ejected from the ion ejection port 83 out of the vacuum 20 by the suction action of the exhaust pump 84.

The first to seventh configurations for forming an asymmetric magnetic field may be applied to any one of the above explained first to fifth embodiments. Further, plural configurations for forming an asymmetric magnetic field may be combined. For example, the configuration of varying current flowing in the two electromagnetic coils (the first configuration) and the configuration of varying the number of turns of the two electromagnetic coils (the second configuration) may be combined.

Next, an extreme ultra violet light source device according to the sixth embodiment of the present invention will be explained by referring to FIGS. 18A and 18B.

Figure 18A:
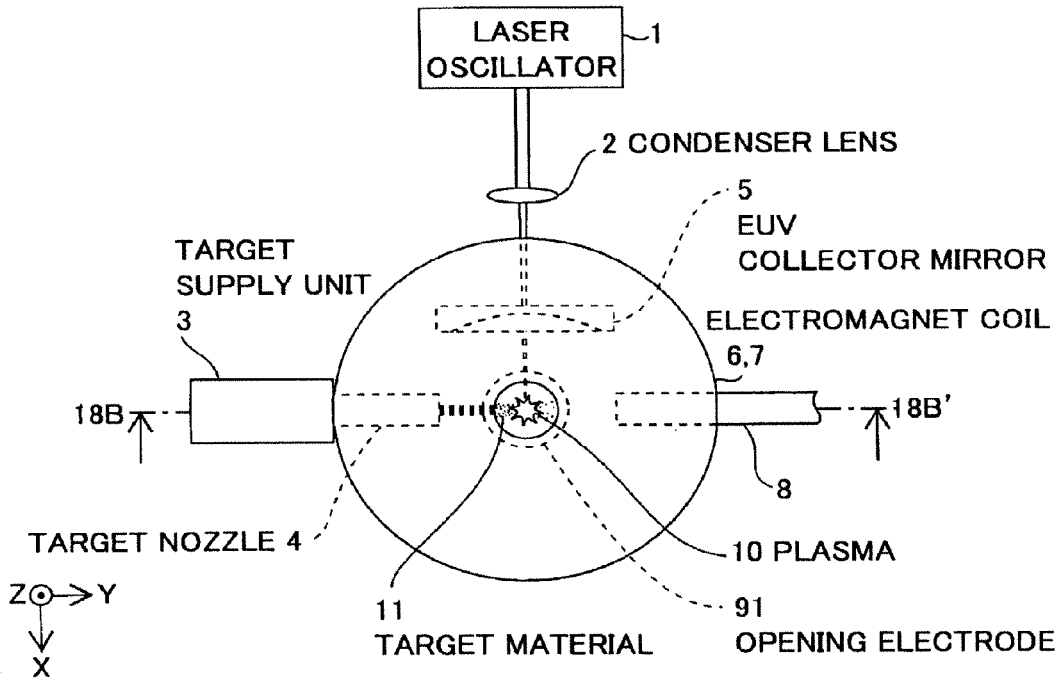
FIGS. 18A and 18B show a configuration of an extreme ultra violet light source device according to the sixth embodiment of the present invention.
Figure 18B:
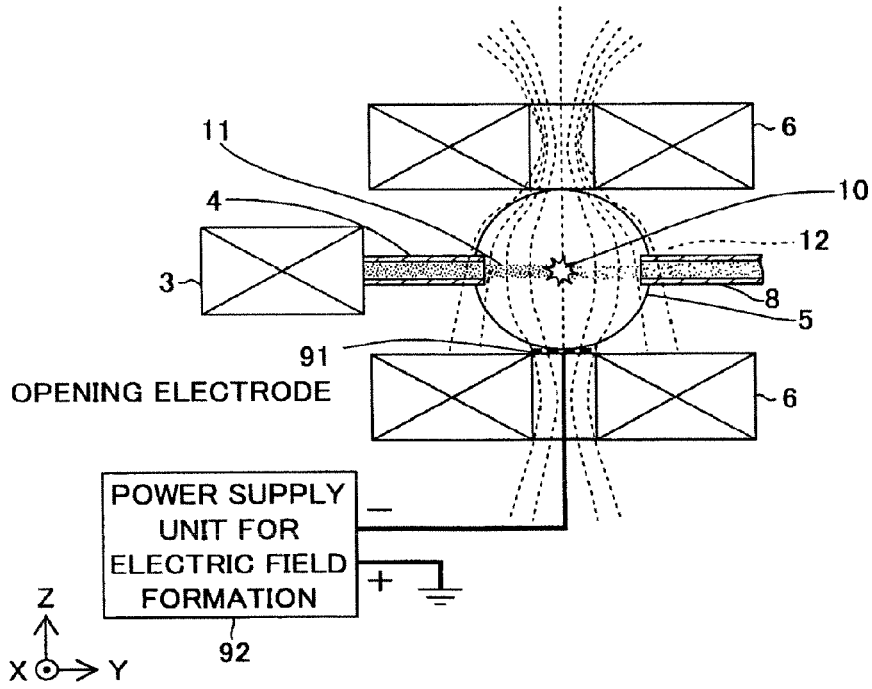

As shown in FIGS. 18A and 18B, the extreme ultra violet light source device further has an opening electrode 91 and a power supply unit 92 for electric field formation in addition to the extreme ultra violet light source device shown in FIGS. 3A and 3B. Other configuration is the same as that shown in FIGS. 3A and 3B.

The opening electrode 91 is a metal member provided with an opening through which ions can pass, and formed of a metal mesh, for example. Further, the negative output of the power supply unit 92 for electric field formation is connected to the opening electrode 91, and the positive output thereof is connected to the ground line. Thereby, an electric field is formed in a part of the asymmetric magnetic field formed by the electromagnetic coils 6 and 7, i.e., in the route in which the ions emitted from the plasma are led out.

Among the ions emitted from the plasma, positively charged ions are led out in the direction toward the lower magnetic flux density (downward in FIG. 18B) along the lines of magnetic flux by the action of the asymmetric magnetic field. In the lead-out route, the positive ions are attracted to the negative opening electrode 91. That is, the movement of ions is further promoted not only by the action of the magnetic field but also by the action by the electric field, and thereby, the ions can be efficiently led out. Furthermore, when the ion ejection port and exhaust pump are provided in the direction in which the ions are led out, ion ejection can be promoted by the suction action of them.

Although the example of applying the means for forming an electric field to the extreme ultra violet light source device shown in FIGS. 3A and 3B is explained in the embodiment, the means may be applied to the extreme ultra violet light source device shown in FIG. 1 or FIGS. 4A-8. Thereby, ion ejection can be further promoted compared to the case of using only the action of the asymmetric magnetic field.

Next, an extreme ultra violet light source device according to the seventh embodiment of the present invention will be explained by referring to FIGS. 19A and 19B.

Figure 19A:
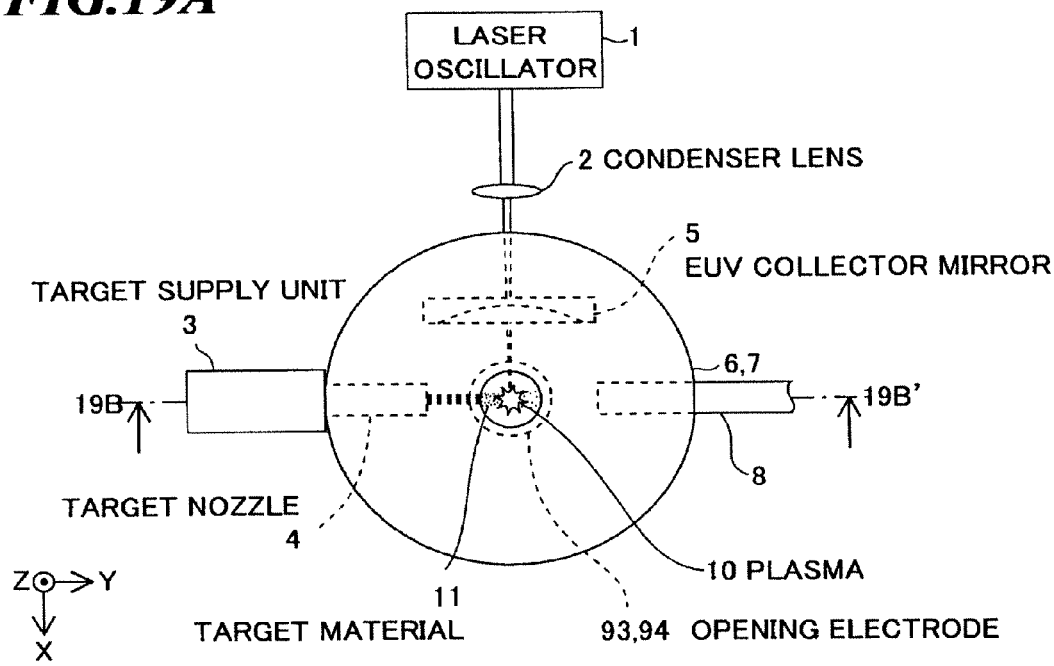
FIGS. 19A and 19B show a configuration of an extreme ultra violet light source device according to the seventh embodiment of the present invention.
Figure 19B:
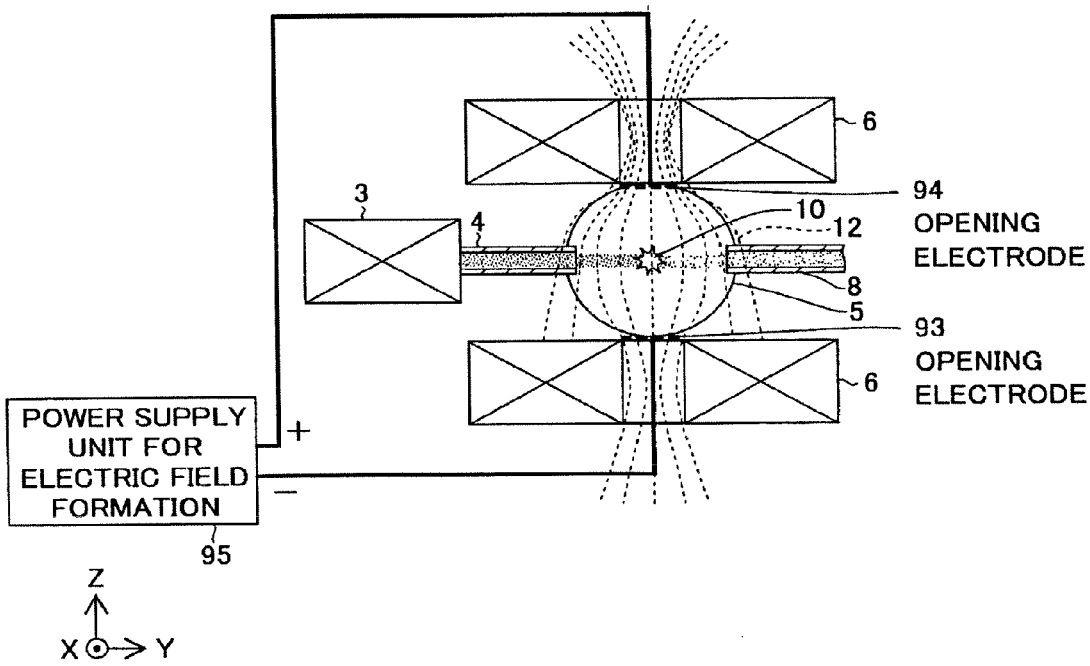

As shown in FIGS. 19A and 19B, the extreme ultra violet light source device further has opening electrodes 93 and 94 and a power supply unit 95 for electric field formation in addition to the extreme ultra violet light source device shown in FIGS. 3A and 3B. Other configuration is the same as that shown in FIGS. 3A and 3B.

The opening electrodes 93 and 94 are metal members provided with openings through which ions can pass, and formed of metal meshes, for example. Further, the negative output of the power supply unit 95 for electric field formation is connected to the opening electrode 93, and the positive output thereof is connected to the opening electrode 94. Thereby, an electric field is formed in a part of the asymmetric magnetic field formed by the electromagnetic coils 6 and 7, i.e., in the route in which the ions emitted from the plasma are led out.

Among the ions emitted from the plasma, positively charged ions are led out in the direction toward the lower magnetic flux density (downward in FIG. 19B) along the lines of magnetic flux by the action of the asymmetric magnetic field. In the lead-out route, the movement of ions is further promoted by the action (downward in FIG. 19B) by the electric field. Thereby, the ions can be efficiently led out. Furthermore, when the ion ejection port and exhaust pump are provided in the direction in which the ions are led out, ion ejection can be further promoted by the suction action of them.

Figure 20:
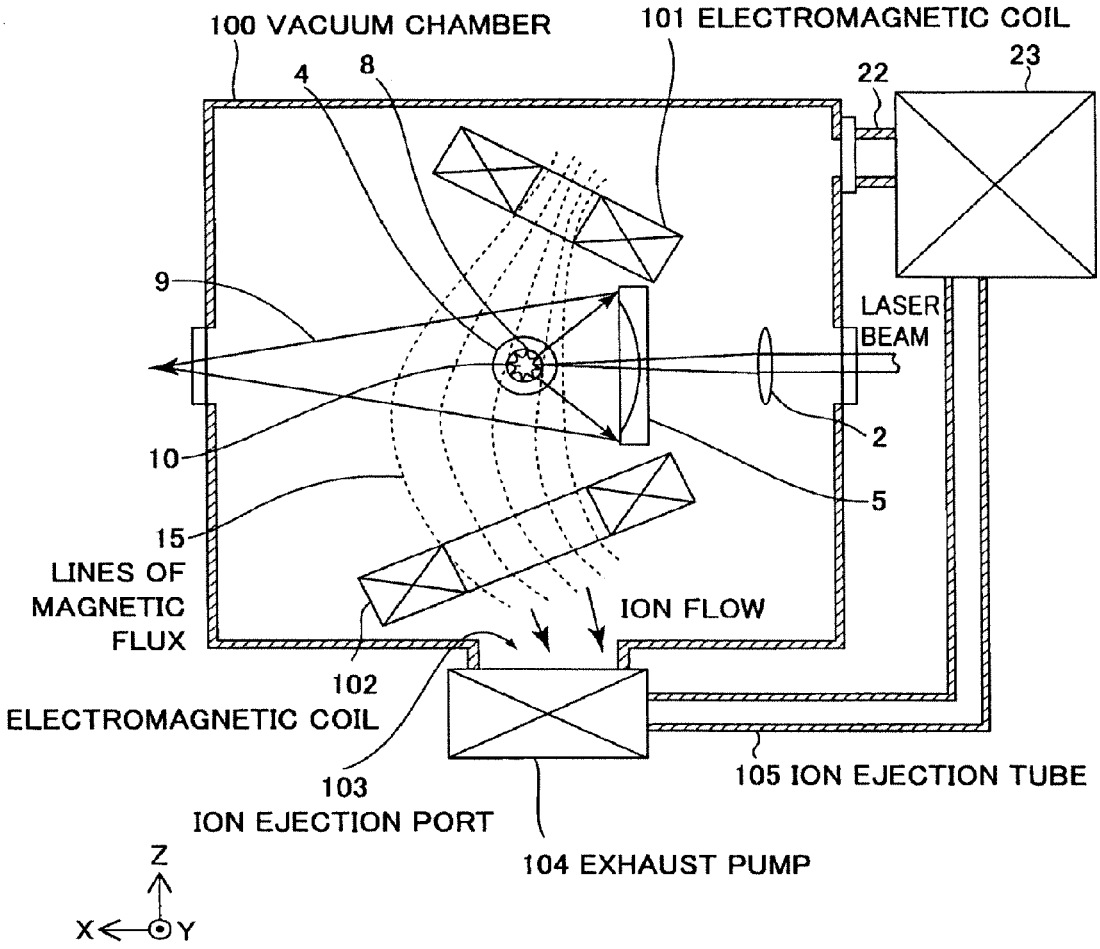
FIG. 20 shows a configuration of an extreme ultra violet light source device according to the eighth embodiment of the present invention.

Next, an extreme ultra violet light source device according to the eighth embodiment of the present invention will be explained by referring to FIG. 20. The extreme ultra violet light source device according to the embodiment is characterized by forming an asymmetric magnetic field without a symmetric axis existing in the magnetic flux direction. In FIG. 20, the target material is injected from the rear side of the paper toward the front (positive Y direction) and the laser beam is outputted from right toward left (positive X direction) of the paper.

As shown in FIG. 20, in the extreme ultra violet light source device according to the embodiment, electromagnetic coils 101 and 102 that generate magnetic fields different from each other in intensity are provided within a vacuum chamber 100. Further, an ion ejection port 103 is formed in the wall of the vacuum chamber 100 near the central opening of the electromagnetic coil 102. Furthermore, an exhaust pump 104 and an ion ejection tube 105 are connected to the ion ejection port 103.

The electromagnetic coil 101 and the electromagnetic coil 102 are provided to face each other at an angle. Thereby, as shown by lines of magnetic flux 15, an asymmetric magnetic field (inhomogeneous magnetic field), in which a central axis of lines of magnetic flux is not a straight line, is formed. Although the electromagnetic coils 101 and 102 having different diameters from each other are shown in FIG. 20, any one of the above-mentioned asymmetric magnetic field forming means (the first to fifth configurations) may be used for varying the magnetic flux density of the magnetic fields generated by the respective coils from each other.

In the extreme ultra violet light source device, the ions emitted from the plasma are guided toward the lower magnetic flux density (toward the electromagnetic coil 102 in FIG. 20) along the lines of magnetic flux by the action of the asymmetric magnetic field, and ejected out of the vacuum chamber 100 through the ion ejection port 103. Simultaneously, the exhaust pump 104 is operated and ion ejection can be promoted by the suction action thereof. The ejected ions are collected by the target circulation unit 23 through the ion ejection tube 105.

Next, an extreme ultra violet light source device according to the ninth embodiment of the present invention will be explained by referring to FIG. 21.

Figure 21:
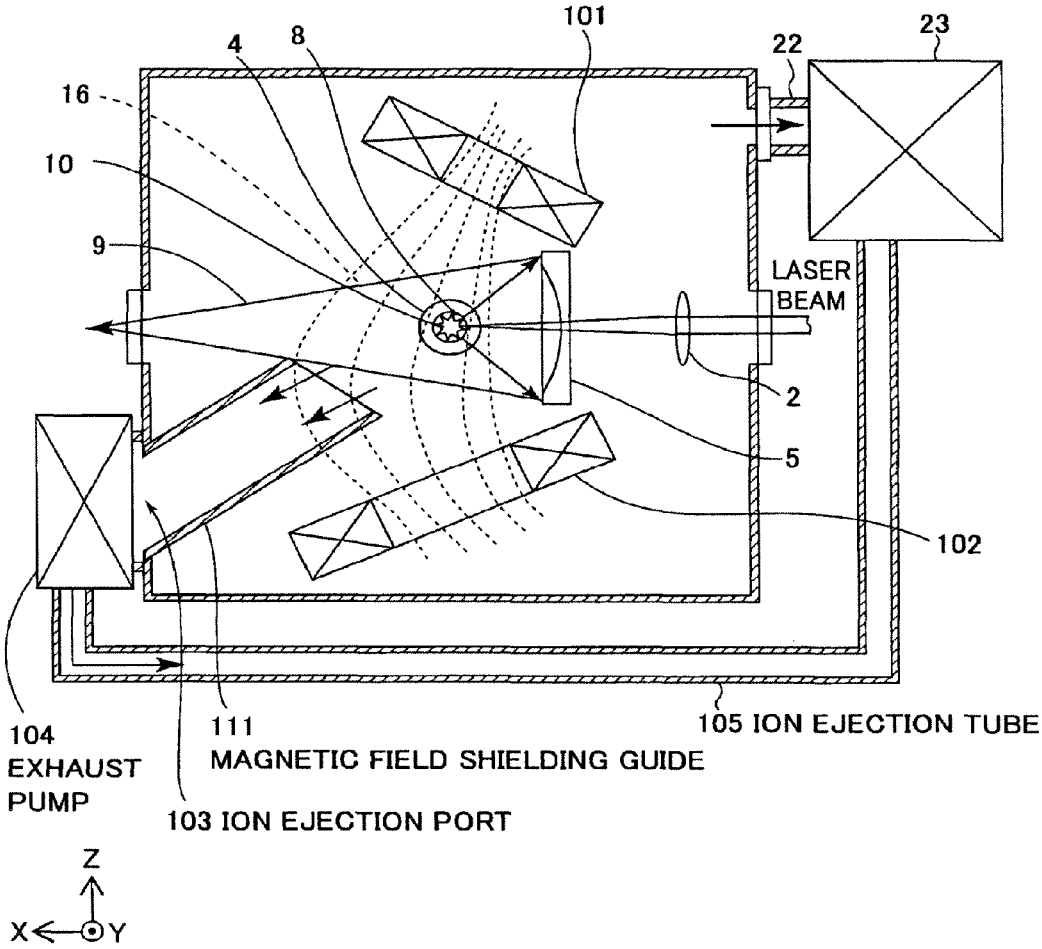
FIG. 21 shows a configuration of an extreme ultra violet light source device according to the ninth embodiment of the present invention.
Figure 22:
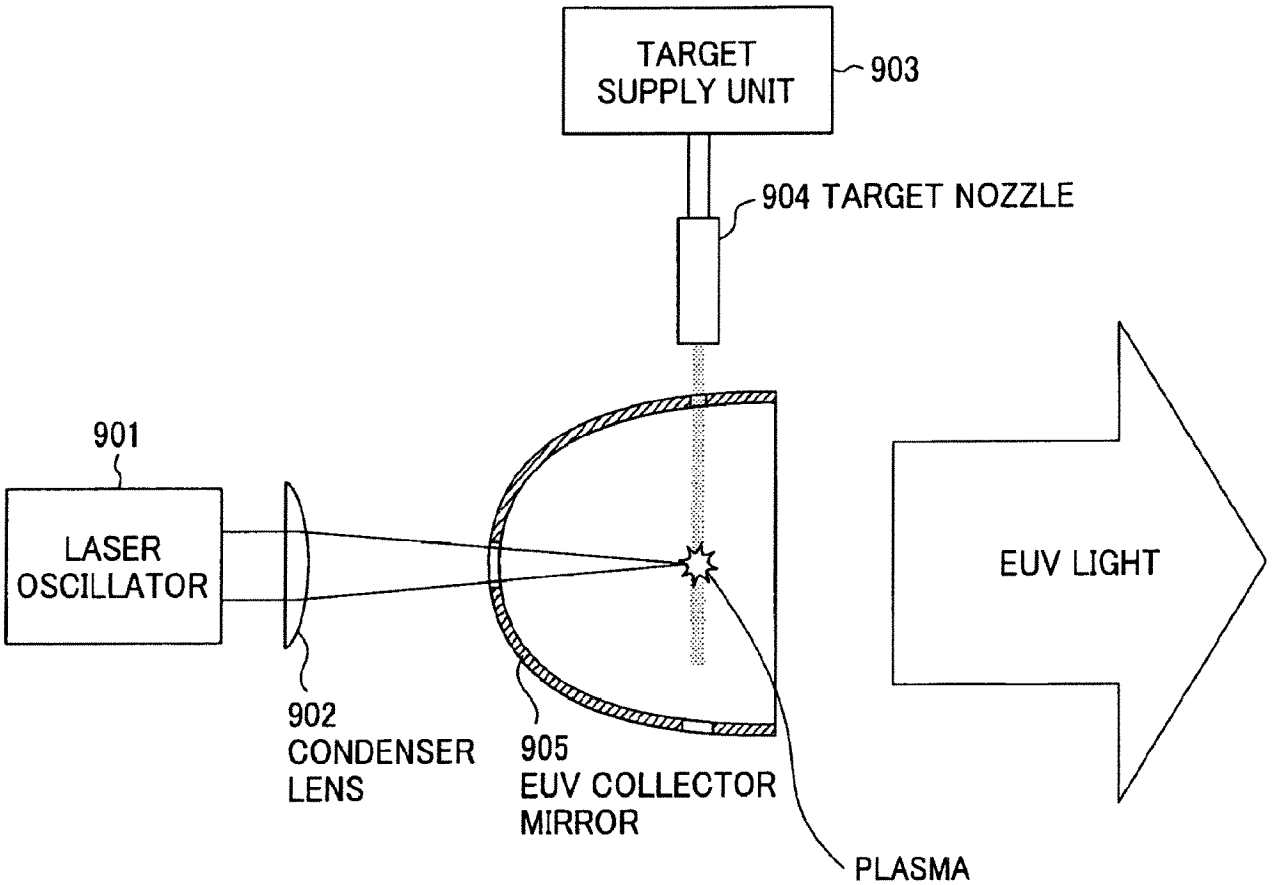
FIG. 22 is a diagram for explaining a principle of generating EUV light in an extreme ultra violet light source device of a laser produced plasma (LPP) type.

The extreme ultra violet light source device shown in FIG. 21 further has a magnetic field shielding guide 111 in addition to the extreme ultra violet light source device shown in FIG. 20. Further, the positions of the ion ejection port 103, the exhaust pump 104, and the ion ejection tube 105 are changed from those shown in FIG. 20. Other configuration is the same as that shown in FIG. 20.

The magnetic field shielding guide 111 is inserted into the asymmetric magnetic field formed by the electromagnetic coils 101 and 102 to shield a part of the magnetic field. The magnetic field shielding guide 111 is formed of a ferromagnetic material such as iron, cobalt, nickel, ferrite, or the like and magnetized in an opposite direction to the magnetic field generated by the electromagnetic coils 101 and 102. Therefore, magnetic field lines hardly enter the magnetic field shielding guide 111 as a ferromagnetic material. Accordingly, an asymmetric magnetic field having low magnetic flux density at a side of the magnetic field shielding guide 111 is formed as shown by lines of magnetic flux 16. Thereby, the ions emitted from the plasma are forced toward the lower magnetic flux density along the lines of magnetic flux.

Further, in the embodiment, the ion ejection port 103 is provided at the end of the magnetic field shielding guide 111. The ions forced by the asymmetric magnetic field are further subjected to the suction action by the exhaust pump 104 near the magnetic field shielding guide 111, and ejected out of the vacuum chamber 100.

According to the embodiment, even in the case where the arrangement of the ion ejection port 103, the exhaust pump 104, and the ion ejection tube 105 is restricted for convenience of design, the direction of ion flow is adjusted by using the magnetic field shielding guide 111, and thereby, the ions can be efficiently ejected.

The second to seventh configurations of the asymmetric magnetic field forming means (FIGS. 10-16B) to be used in the second to ninth embodiments, the means for forming an electric field in an asymmetric magnetic field (FIGS. 18A and 18B, FIGS. 19A and 19B), and the asymmetric magnetic field forming means without a symmetric axis in the magnetic flux direction (FIGS. 20 and 21) are applicable to either the case of inserting an iron core into the electromagnetic coil or the case of inserting no iron core.

As explained above, according to the first to ninth embodiments of the present invention, the ions emitted from the plasma can be led out in a desired direction by the action of the asymmetric magnetic field. Therefore, by promptly removing ions from the vicinity of the EUV collector mirror, the contamination and damage on the EUV collector mirror can be suppressed and the component life can be made longer. Further, the reduction in reflectance of the EUV collector mirror can be suppressed, and the reduction in EUV light use efficiency can be prevented. Furthermore, by promptly removing ions from the vicinity of the plasma emission point, the absorption of the EUV light by ions can be suppressed and EUV light use efficiency can be improved. As a result, a reduction in costs at the time of operation of the EUV light source device and a reduction in costs produced at the time of maintenance and replacement of parts can be realized, and further, the availability factor of exposure equipment employing the EUV light source device and the productivity of semiconductor devices by the exposure equipment can be improved.

The invention claimed is:

1. An extreme ultra violet light source device of a laser produced plasma type comprising:

a target supply unit configured to supply a target material;

a chamber in which plasma is generated by irradiating the target material with a laser beam;

collector optics configured to collect extreme ultra violet light radiated from the plasma; and a magnetic field forming unit including (1) plural coils configured to form, when applied with electric currents, magnetic fields having different intensity from each other at both sides of a position where the target material is irradiated with the laser beam and (2) a shielding unit configured to shield a part of the magnetic fields formed by said plural coils.

2. The extreme ultra violet light source device according to claim 1, wherein said magnetic field forming unit includes plural magnetic cores having different shapes from each other and/or different sizes from each other and inserted into central openings of said plural coils, respectively.

3. The extreme ultra violet light source device according to claim 1, wherein said plural coils includes superconducting coils.

4. The extreme ultra violet light source device according to claim 1, wherein said magnetic field forming unit is configured to apply electric currents having different magnitudes from each other to said plural coils, respectively.

5. The extreme ultra violet light source device according to claim 1, wherein said magnetic field forming unit is configured to apply electric currents in different directions from each other to said plural coils, respectively.

6. The extreme ultra violet light source device according to claim 1, wherein numbers of turns and/or diameters of turns of winding wires in said plural coils are different from each other.

7. The extreme ultra violet light source device according to claim 1, wherein said magnetic field forming unit is configured to form asymmetric magnetic fields in which a central axis of lines of magnetic flux is not a straight line.

8. The extreme ultra violet light source device according to claim 7, wherein said plural coils are provided to face each other at a predetermined angle.

9. The extreme ultra violet light source device according to claim 1, wherein said magnetic field forming unit is configured to form asymmetric magnetic fields with respect to a surface perpendicular to a central axis of lines of magnetic flux.

10. The extreme ultra violet light source device according to claim 9, wherein said magnetic field forming unit is configured to form asymmetric magnetic fields having a higher magnetic flux density at one side of a central axis of lines of magnetic flux and a lower magnetic flux density at the other side thereof.

11. The extreme ultra violet light source device according to claim 1, further comprising:

an ion ejection port provided in a direction from a higher magnetic flux density to a lower magnetic flux density of the magnetic fields formed by said magnetic field forming unit.

12. The extreme ultra violet light source device according to claim 1, further comprising:

an electric field forming unit configured to form an electric field in the magnetic fields formed by said magnetic field forming unit.

13. The extreme ultra violet light source device according to claim 1, wherein a central axis of said target supply unit is oriented in a direction perpendicular to a central axis of lines of magnetic flux of the magnetic fields formed by said magnetic field forming unit.

14. The extreme ultra violet light source device according to claim 1, wherein said shielding unit contains one of iron, cobalt, nickel and ferrite.

15. An extreme ultra violet light source device of a laser produced plasma type comprising:

a target supply unit configured to supply a target material;

a chamber in which plasma is generated by irradiating the target material with a laser beam;

collector optics configured to collect extreme ultra violet light radiated from the plasma; and a magnetic field forming unit including (1) plural permanent magnets configured to form magnetic fields having different intensity from each other at both sides of a position where the target material is irradiated with the laser beam and (2) a shielding unit configured to shield a part of the magnetic fields formed by said plural permanent magnets.

16. The extreme ultra violet light source device according to claim 15, wherein said shielding unit contains one of iron, cobalt, nickel and ferrite.

17. The extreme ultra violet light source device according to claim 15, wherein said magnetic field forming unit is configured to form asymmetric magnetic fields in which a central axis of lines of magnetic flux is not a straight line.

18. The extreme ultra violet light source device according to claim 17, wherein said plural permanent magnets are provided to face each other at a predetermined angle.

* * * * *